US006550764B2

(12) United States Patent
Wilson et al.

(10) Patent No.: US 6,550,764 B2
(45) Date of Patent: Apr. 22, 2003

(54) APPARATUS AND METHOD FOR CONTROLLING A DOCUMENT-HANDLING MACHINE

(75) Inventors: Shae L. Wilson, New York Mills, NY (US); Gary S. Jacobson, Norwalk, CT (US)

(73) Assignee: Pitney Bowes Inc., Stamford, CT (US)

( * ) Notice: Subject to any disclaimer, the term of this patent is extended or adjusted under 35 U.S.C. 154(b) by 127 days.

(21) Appl. No.: 09/785,786

(22) Filed: Feb. 16, 2001

(65) Prior Publication Data

US 2002/0140156 A1 Oct. 3, 2002

(51) Int. Cl.[7] ..... B65H 5/34; G03G 15/00
(52) U.S. Cl. ..... 271/270; 399/396
(58) Field of Search ..... 271/270; 399/396; 198/292

(56) References Cited

U.S. PATENT DOCUMENTS 4,451,027 A * 5/1984 Alper ..... 198/461.1
5,423,527 A * 6/1995 Tranquilla ..... 271/10.02
5,445,369 A * 8/1995 Golicz et al. ..... 271/12
6,135,441 A 10/2000 Belec et al. ..... 271/35

* cited by examiner

*Primary Examiner*—Donald P. Walsh
*Assistant Examiner*—Kenneth W. Bower
(74) *Attorney, Agent, or Firm*—Thomas F. Presson; Charles R. Malandra, Jr.; Angelo N. Chaclas

(57) ABSTRACT

A document-handling apparatus and method for transporting documents along a document feed path from an upstream end to a downstream end. The apparatus includes at least one document-handling subassembly along the document feed path for singulating the documents, controlling gaps between the documents, and conveying the documents toward the downstream end; a sensor mounted along the document feed path for sensing the positions of the documents and for generating position signals based on the document positions; and a control apparatus for receiving the position signals and for controlling the velocity and acceleration of the document-handling subassembly so as to regulate the size of the document gaps and to maximize document throughput. The document-handling subassemblies can include a stack advance mechanism, an input feeder, one or more singulators, and one or more output feeders. A trap can also be included to stop a document along the feed path. The apparatus can operate at accelerations as low as 0.5 g, enabling documents to be transported with constant motion through the apparatus, thereby maintaining efficient interdocument gaps without using high accelerations.

13 Claims, 11 Drawing Sheets

APPARATUS AND METHOD FOR CONTROLLING A DOCUMENT-HANDLING MACHINE

BACKGROUND

This invention relates generally to the field of handling documents and document-handling machines. More specifically, this invention relates to controlling the timing and motion of documents in a document-handling machine, especially that of mailpieces in a mail-handling machine.

The processing and handling of mailpieces and other documents consumes an enormous amount of human and financial resources, particularly if the processing of the mailpieces is done manually. The processing and handling of mailpieces is performed not only by the Postal. Service, but also by each and every business or other site that communicates via the mail delivery system. Various pieces of mail generated by many departments and individuals within a company must be collected, sorted, addressed, and franked as part of the outgoing mail process. Additionally, incoming mail must be collected and sorted efficiently to ensure that addressees receive it in a minimal amount of time. Because much of the documentation and information being conveyed through the mail system is critical to the success of a business, it is imperative that the processing and handling of both the incoming and outgoing mailpieces be performed efficiently and reliably so as not to negatively affect the functioning of the business.

In view of the above, various automated mail-handling machines have been developed for processing mail (i.e., removing individual pieces of mail from a stack and performing subsequent actions on each individual piece of mail). However, in order for these automatic mail-handling machines to be effective, they must process and handle "mixed mail," which means sets of intermixed mailpieces of varying size (from postcards to 9"×14" flats), thickness, and weight. In addition, "mixed mail" also includes "stepped mail" (e.g., an envelope containing an insert which is smaller than the envelope, thereby creating a step in the envelope), tabbed and untabbed mail products, and mailpieces made from different substrates. Thus, the range of types and sizes of mailpieces which must be processed is extremely broad and often requires trade-offs to be made in the design of mixed-mail feeding devices in order to permit effective and reliable processing of a wide variety of mixed mailpieces.

In known mixed-mail handling machines that separate and transport individual pieces of mail away from a stack of mixed mail, the stack of mixed mail is first loaded onto some type of conveying system for subsequent sorting into individual pieces. The stack of mixed mail is advanced as a stack by an external force provided by a stack advance mechanism to, for example, a shingling device. The shingling device applies a force to the lead mailpiece in the stack to initiate the separation of the lead mailpiece from the rest of the stack by shingling it slightly relative to the stack. The shingled mailpieces are then transported downstream to, for example, a separating or singulating device ("singulator") that completes the separation of the lead mailpiece from the stack so that individual pieces of mail may be transported further downstream for subsequent; processing.

In such a mail-handling machine, the various forces acting on the mailpieces in advancing the stack, shingling the mailpieces, separating the mailpieces, and moving the individual mailpieces downstream often act counterproductively relative to each other. For example, inter-document stack forces exist between each of the mailpieces that are in contact with each other in the stack. These inter-document forces created by the stack advance mechanism, the frictional forces between the documents, and electrostatic forces that may exist between documents, tend to oppose the force required to shear the lead mailpiece from the stack. Additionally, the interaction of the force used to drive the shingled stack toward the singulator and the forces at the singulator can potentially cause a thin mailpiece to be damaged by being buckled as it enters the singulator. Furthermore, in a conventional singulator, there are retard belts and feeder belts that are used to separate the mailpiece from the shingled stack. Both the forces applied by the retard belts and the feeder belts must be sufficient to overcome the inter-document forces previously discussed. However, the friction force generated by the retard belts cannot be, greater than that generated by the feeder belts or the mailpieces will not be effectively separated and fed downstream to the next mail processing device. Moreover, if the feeding force applied to the mailpieces for presenting them to the singulator is too great, "multi-feeding" may occur in which several mailpieces are forced through the singulator without being successfully separated.

Although strong forces seem to be, desirable to accelerate and separate the mailpieces reliably and efficiently, these same strong forces can damage (e.g., buckle) lightweight mailpieces being processed. In response, weak forces may be used to accelerate and separate the mailpieces, but these forces result in poor separation, a lower throughput, and stalling of the mailpieces being processed. The problem is that when both thin mailpieces; which are flimsy and require weak forces to prevent them from being damaged, and thick/heavy mailpieces, which are sturdy and require strong forces for proper separation and feeding, are in the mail stack, stronger stack normal forces may be created due to the thick/heavy mail, requiring stronger nip forces at the singulator; and, these forces may damage the thin mailpieces.

Thus, the apparatus used to separate a stack of mixed mail must take into account the counterproductive nature of the forces acting on the mailpieces and produce an effective force profile acting on the mailpieces throughout their processing cycle to effectively and reliably separate and transport the mailpieces at very high processing speeds (e.g., four mailpieces per second) without physically damaging the mailpieces. However, because the desired force profile acting on a particular mailpiece depends upon the size, thickness, configuration, weight, and substrate of the individual mailpiece being processed, the design of a mixed-mail feeder which can efficiently and reliably process a wide range of different types of mixed mailpieces has been extremely difficult to achieve.

SUMMARY OF THE INVENTION

The present invention provides an apparatus and method for transporting documents along a document feed path from an upstream end to a downstream end. The apparatus includes at least one document-handling subassembly along the document feed path for singulating the documents, controlling gaps between the documents, and/or conveying the documents toward the downstream end; a sensor mounted along the document feed path for sensing the positions of the documents and for generating position signals based on the document positions; and a control apparatus for receiving the position signals and for controlling the velocity and acceleration of the document-handling subassembly so as to regulate the size of the document gaps and to maximize document throughput.

Preferably, the document-handling subassembly includes a singulator. The apparatus may also include a second document-handling subassembly such as an input feeder, between the singulator and the upstream end, for feeding documents along the document feed path, a conveyor belt running between the singulator and the downstream end for conveying the documents downstream along the document feed path after the documents leave the singulator, an aligning area downstream from the singulator, through which the documents are bottom-edge aligned as they are conveyed on the conveyor belt, and a third document-handling subassembly such as a second singulator, placed downstream the aligning area, for further singulating the documents as they are transported from the aligning area. Preferably, the sensor transmits signals to coherently control the velocity and acceleration of the input feeder and singulators so as to control the size of the document gaps and maximize document throughput.

Other document-handling subassemblies include a stack advance mechanism at the upstream end for advancing to the input feeder documents from a document stack at the upstream end, a first output feeder between the singulator and the aligning area for taking the documents from the singulator, and a second output feeder between the second singulator and the downstream end for taking the documents from the second singulator to the downstream end.

Preferably, the sensor is aligned with the beginning of the nip area of the singulator. More preferably, there are at least second through eighth sensors placed downstream the sensor, as follows: the second sensor is aligned after the nip of the singulator; the third and fourth sensors are aligned before and after the nip of the first output feeder, respectively; the fifth and sixth sensors are aligned with the aligning area; the seventh sensor is aligned before the nip-of the second singulator; and the eighth sensor is aligned with the nip of the second output feeder.

Preferably, the sensor and the second sensor can sense when a document is clear of the singulator, so as to start the input feeder and singulator operating. The third sensor can sense when a document is in the first output feeder, so as to stop the first output feeder from operating if the stop flag is set. The fourth sensor can sense when a document is clear of the first output feeder, so as to start the singulator operating unless the stop flag is set. The fourth sensor can also sense when a document is in the first output feeder, so as to set the stop flag in conjunction with the fifth and sixth sensors. The fifth and sixth sensors can sense an unacceptably small document gap, so as to set the stop flag. The seventh sensor can sense an acceptable document gap, so as to clear the stop flag and to accelerate the first output feeder after the stop flag is cleared. The eighth sensor can sense when a document is clear of the second output feeder, so as to cause the second singulator to send a second document into the second output feeder.

Preferably, the aligning area also includes a seventh document-handling subassembly, e.g., a trap, for preventing a document from being conveyed along the document feed path when the gap between the document and a downstream document is unacceptably small and the first output feeder is unable to stop the document.

The apparatus of the present invention can operate at accelerations as low as 0.5 g, enabling documents to be transported with constant motion through the apparatus, thereby maintaining efficient inter-document gaps without using high accelerations.

Additional advantages of the invention will be set forth in the description which follows, and in part Will be obvious from the description, or may be learned by practice of the invention. The advantages of the invention may be realized and obtained by means of the instrumentalities and combinations particularly pointed out in the appended claims.

BRIEF DESCRIPTION OF THE DRAWINGS

The accompanying drawings, in which like reference numerals represent like parts, are incorporated in and constitute a part of the specification. The drawings illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
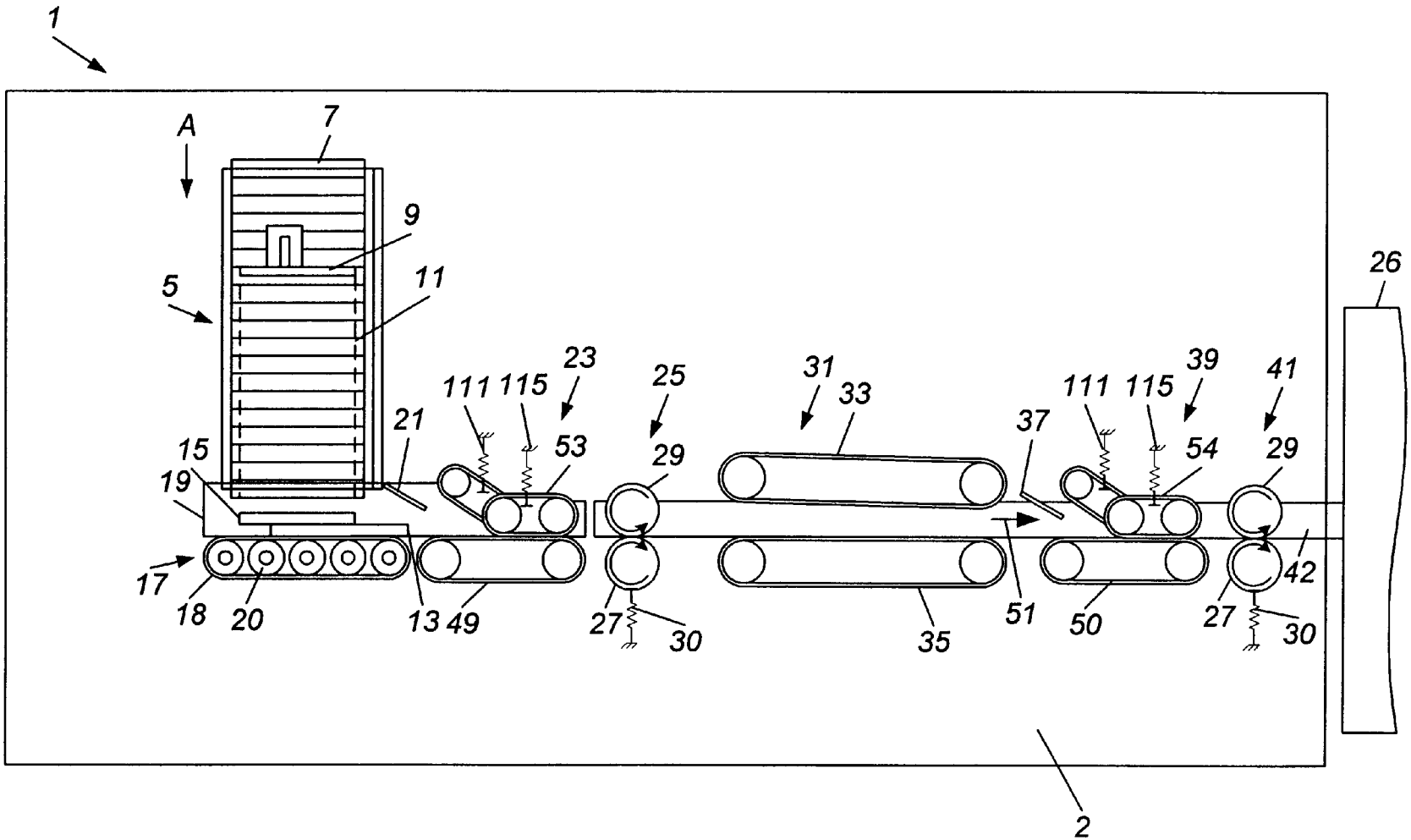
FIG. 1 (PRIOR ART)
FIG. 1 is a schematic top plan view of a mixed-mail feeder of the prior art.

FIG. 1 shows a mixed-mail feeder 1 having conventional framework 2 upon which all of the components of the mixed-mail feeder 1 are mounted. Mixed-mail feeder 1 includes a stack advance mechanism 5 having a continuous conveyor belt 7 mounted for conventional rotation about a plurality of pulleys (not shown) in the direction of arrow "A." Mounted on the conveyor belt 7 in a conventional manner is an upstanding panel 9 which moves with the conveyor 7 in the direction of arrow "A." During operation, a stack 11 of mixed mail is placed on the conveyor belt 7 and rests against the panel 9. Mixed-mail stack 11 includes a lead mailpiece 13 and a second mailpiece 15. Thus, as conveyor belt 7 begins to move, mixed-mail stack 11 is directed toward an input feeder 17 (also called an "input feed structure" or "nudger"). Input feeder 17 includes a belt 18 which is driven into rotation about a series of pulleys 20, at least one of which is a driven pulley. Accordingly, as stack advance mechanism 5 forces lead mailpiece 13 into contact with belt 18, lead mailpiece 13 is laterally moved away from mixed-mail stack 11. Additionally, a driven belt 19, which makes contact with the bottom edge of lead mailpiece 13, also assists in moving lead mailpiece 13 downstream past a guide mechanism 21 and toward a first document singulator 23 (or "singulating apparatus" or "separator"). As shown, the combination of stack advance mechanism 5, input feeder 17, and guide plate 21 helps to present the mailpieces-which are removed from mixed-mail stack 11 into first singulator 23 in a shingled manner as is more clearly shown in FIG. 2.

First singulator 23 operates to separate lead mailpiece 13 from the remaining mixed-mail stack 11, so that only individual mailpieces are presented to first output feeder 25 for ultimate processing downstream to a processing station 26, which performs some type of operation (e.g., metering, scanning, etc.) on each individual mailpiece. First singulator 23 includes a feed assembly 49 for feeding each individual document of the stack 43 of shingled mailpieces downstream along a path of travel 51. First singulator 23 further includes a retard assembly 53 for feeding each next successive document of shingled mailpiece stack 43, upstream relative to path of travel 51. That is, feed assembly 49 interacts with lead mailpiece 13 to move it downstream along path of travel 51, while retard assembly 53 causes the remainder of the documents in shingled mailpiece stack 43 to be moved slightly upstream. Springs 111 and 115 allow the belts and pulleys that make up retard assembly 53 to resist lateral movement due to downstream travel of shingled mailpiece stack 43. The forces respectively exerted by feed assembly 49 on lead mailpiece 13 and retard assembly 53 on the remaining documents in the stack are sufficient to overcome the inter-document force between the lead mailpiece and the next successive document in the stack. Thus, when first singulator 23 operates as intended, only one document at a time leaves first singulator 23 for presentation to first output feeder 25. First singulator 23 is further described in U.S. Pat. No. 6,135,441, assigned to the assignee of this invention, the disclosure of which is hereby incorporated by reference.

From first singulator 23, the separated individual mailpiece is then fed to first output feeder 25. First output feeder 25 (or "output feed structure") includes "take-away" rollers 27, 29 which receive the mailpiece as it exits first singulator 23 and help to transport the mailpiece downstream. Although first output feeder 25 is shown in FIG. 1 as a roller pair, it could include a belt pair instead of the rollers. The take-away rollers comprise a drive roller 29 and an idler roller 27. Take-away idler roller 27 is spring loaded by spring 30 and is moveable toward and away from take-away drive roller 29 to accommodate different mailpiece thicknesses. First output feeder 25 transports the mailpiece to the next stage, aligner 31.

Aligner 31 (also known as a "deskew area" or a "buffer station"), consisting of two driven belt structures 33, 35, helps to buffer the individual mailpieces to ensure that they are aligned on their bottom edges prior to transport downstream. Acting on the bottom edges of the mailpieces is a driven-transport belt 42, which transports the mailpieces from first output feeder 25 through buffer station 31 to processing station 26. Preferably, belt structures 33, 35 may be separated from each other on each side of the mailpiece feed path 51 by a distance of approximately 1.5 inches. This spacing allows most multi-feeds which leave first singulator 23 to be transported through aligner 31 without any large inter-document forces existing between the mailpieces (such as frictional forces), because no significant normal feed force is present when the mailpieces are fed by transport belt 42. Additionally, it has been found that by using driven belts 33, 35, mailpieces which curl up in aligner 31 are still transported out of aligner 31. In an alternative embodiment, driven belts 33, 35 could be replaced with fixed-wall structures such as those described in U.S. patent application Ser. No. 09/411,064, assigned to the assignee of this invention, the disclosure of which is hereby incorporated by reference. In such an embodiment, the distance between the walls may be different from the distance disclosed above, based on the maximum height and thickness of the mailpieces handled by the mixed-mail feeder and the height of the walls lining aligner 31. In addition, antistatic brushes may be mounted onto the fixed-wall structures to help prevent lightweight, static-prone mailpieces, such as envelopes, postcards, and mailpieces wrapped in TYVEK® (manufactured by DuPont), from clinging to the walls.

Figure 3:
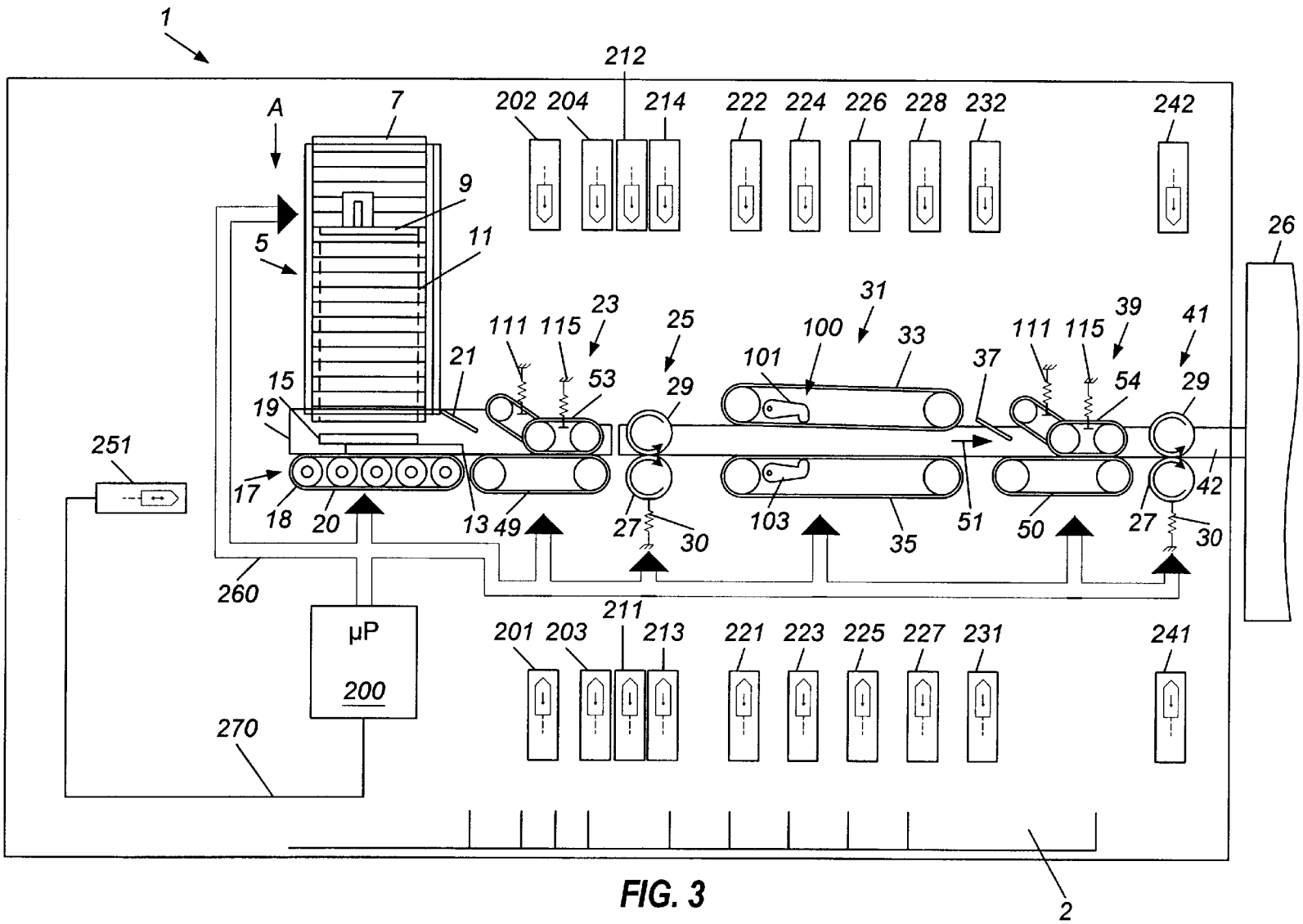
FIG. 3 is a schematic top plan, view of the mixed-mail feeder of FIG. 1 incorporating an embodiment of the present invention.

In addition, aligner 31 could also include a trap subsystem 100 (shown in FIG. 3), which controls the gap size between mailpieces. Gaps are important because the mail-handling machine may need time for processing that occurs downstream in processing station 26, such as optical character recognition (OCR) processing. Additionally, proper gap size affects throughput of the mail-handling machine and is also helpful in a situation in which there is a multi-feed going into a second document singulator 39, as described below. Trap 100 allows transport belt 42 to remain in constant motion while an inter-piece gap is being maintained or lengthened, instead of attempting to achieve the gap by stopping and starting transport belt 42, which would stop all of the mailpieces on the belt instead of just the mailpieces between which a larger gap is desired. FIG. 3 shows trap 100 comprising two trap levers 101, 103 (shown in the open, non-trapping position) which are actuated in order to grab a mailpiece as it moves through aligner 31.

From aligner 31, the mailpieces are transported on transport belt 42 past a second guide plate 37 and into second singulator 39. This singulator is shown in FIG. 1 to have the identical structure as first singulator 23, where feed assembly 50 and retard assembly 54 of second singulator are equivalent to feed assembly 49 and retard assembly 53 of first singulator 23. The feed and retard assemblies of second singulator 39 are shown in FIG. 1 as being positioned along feed path 51 with the same orientation as the feed and retard assemblies of first singulator 23. However, in various embodiments of the mixed-mail feeder, the feed and retard assemblies of first singulator 23 could be disposed on opposite sides of feed path 51 as compared to the corresponding structure in second singulator 39 (and second guide plate 37 would also be disposed on the opposite side of feed path 51). Such opposite disposition is only a desired configuration, however, if the mixed-mail feeder has not already sorted a mail stack at least once. In that case, oppositely disposed singulators could disrupt the sorted order of the mail.

Furthermore, second singulator 39 may not appear in some embodiments. It is preferable, however, to include second singulator 39 because the use of a redundant singulator improves the reliability of separating individual documents from each other. In the case where a multi-feed does pass through first singulator 23, it is likely that second singulator 39 will effectively separate the documents, of the multi-feed. Additionally, because of the use of second singulator 39, the singulating nip force at first singulator 23 (as well as at second singulator 39) applied by each of the springs 111, 115 can be significantly reduced, thereby preventing damage to thin mailpieces being processed through singulators 23 and 39. In other words, because second singulator 39 provides a second opportunity to separate any multi-feeds that may occur, problems associated with reducing the nip force in a single singulator structure are largely eliminated.

Subsequent to passing through second singulator 39, the individual mailpieces are transported into a second output feeder 41 (identical to first output feeder 25) which acts on the mailpieces together with transport belt 42 to transport the individual mailpieces to processing station 26.

The mixed-mail feeder shown in FIG. 1 and described above, however, may still encounter some transport problems. It was discussed above, with respect to aligner 31, that trap subsystem 100 could be incorporated to trap documents in order to control gap size between mailpieces and to improve throughput of the mail-handling machine. One method of enforcing gap is described in aforementioned U.S. patent application Ser. No. 09/411,064. That reference enforces gap by adding a number of sensors mounted along feed path 51. The sensors detect the positions of the mailpieces and actuate trap levers 101, 103 any time too small a gap exists between mailpieces which can not be widened by some other upstream document-handling subassembly such as take-away rollers 27, 29 of first output feeder 25. The trap subsystem is actuated using an electromagnetic solenoid actuator controlled by a microprocessor controller.

Gap size can also be controlled in other ways. U.S. patent application Ser. No. 09/411,064 also discloses an alternative embodiment to the trap subsystem. That alternative embodiment uses upstream and downstream transport belts, with a small space between them, instead of a single transport belt 42. The upstream belt begins at first output feeder 25 and ends in the middle of aligner 31. The downstream belt begins in the middle of aligner 31, slightly downstream from the end of the upstream belt, and continues to processing station 26. When a sensor aligned with second singulator 39 senses a multi-feed in that singulator, and a second sensor aligned with output feeder 41 senses a mailpiece in that output feeder, the upstream belt is stopped which allows the downstream belt to clear the multi-feeds or enlarge the document gaps.

Nevertheless, the gap control mechanisms disclosed in U.S. patent application Ser. No. 09/411,064 only control discrete parts of the mixed-mail feeder. What is needed is a more comprehensive and coherent control system to better enforce gap size and to increase document throughput.

The present invention accomplishes these tasks by using sensors mounted along document feed path 51 to coherently control the velocity and acceleration of stack advance mechanism 5, input feeder 17, first singulator feed assembly 49, first output feeder 25, and second singulator feed assembly 50. Preferably, the present invention also controls the actuation of trap subsystem 100.

FIG. 3 is a schematic top plan view of the mixed-mail feeder of FIG. 1 incorporating an embodiment of the present invention. In addition to the features described with respect to FIG. 1, FIG. 3 also includes light sensors 201–241 and 251, light transmitters 202–242, microprocessor controller. 200, control signal bus 260, and sensor signal bus 270. Sensors 201–241 and transmitters 202–242 are mounted along document feed path 51. Each sensor may be, for example, a photoelectric sensor for detecting light. As shown in FIG. 3, each odd sensor 201–241 may be paired with an even transmitter 202–242 forming a detection pair. Light may be transmitted from the even transmitter to the odd sensor. An absence of light detected by the sensor (i.e., the sensor is blocked) indicates that a mailpiece is on transport belt 42 in the area of that sensor, and the presence of light detected by the sensor indicates that there is no mailpiece in the area of the sensor. The use of detection pairs to indicate the presence or absence of a mailpiece between the detection pair is only one sensor configuration. Other types of sensors and detection configurations can be used. For instance, sensor 251 does not have a transmitter associated with it, yet it is able to detect the position of, input feeder 17 by sensing the presence or absence of light caused by the input feeder's movement during document handling.

FIG. 3 depicts stack advance mechanism 5 and the first and second singulators in the same orientation with respect to each other as is shown in FIG. 1. However, in some embodiments of the present invention, it is more advantageous (for downstream processing reasons, for example) for the stack advance mechanism to be placed toward the bottom of FIG. 3, with first and second singulators also oriented in the opposite position from that shown in FIG. 3 [i.e., first singulator feed assembly 49 is positioned "above" (more toward the top of FIG. 3 than) first singulator retard assembly 53]. In those cases, mail is fed in the direction opposite to that shown by arrow "A." In either case, however, the present invention operates the same.

The position signals generated by sensors 201–241, 251 are transmitted to microprocessor controller 200 using sensor signal bus 270. Microprocessor 200 receives the position signals and coherently controls the velocity and acceleration of various structures of mixed-mail feeder 1 according to a protocol described below. The control signals generated by microprocessor controller 200 are transmitted to the various document handling structures using control signal bus 260.

An objective of the present invention is to transport as many mailpieces as possible without jamming, creating multi-feeds, or unnecessarily accelerating or decelerating the mailpieces. The sensors and the various document-handling subassemblies, such as stack advance mechanism 5, input feeder 17, first and second singulator feed assemblies 49, 50, first and second output feeders 25, 41, and aligner 31, operate coherently as follows.

Sensor 251 detects the position of input feeder 17 so as to control stack advance mechanism 5. As previously described with respect to FIG. 1, conveyor belt 7 begins to move, directing mixed-mail stack 11 toward input feeder 17, which is deflected in the direction "A." The more force with which stack advance mechanism 5 pushes, the more deflection of input feeder 17, and the more normal inter-document force is generated in mixed-mail stack 11. Sensor 251 is positioned with respect to input feeder 17 so that when sensor 251 is triggered, input feeder 17 is receiving too great an amount of force from stack advance mechanism 5. In that case, sensor 251 generates and transmits to microprocessor 200 a signal that the force on input feeder 17 is too great. In a preferred embodiment, there is also a tilt sensor (not shown) in input feeder 17 which senses the position of the input feeder. This sensor generates and transmits to microprocessor 200 a signal that input feeder 17 is tilted too much due to too much force from stack advance mechanism 5. In response to sensor 251 and the tilt sensor, microprocessor 200 transmits a control signal to stack advance mechanism 5 to stop advancing mixed-mail stack 11. Stopping the stack advance mechanism also permits the input feeder to be activated (when the proper situation arises downstream, as will be discussed below); when the stack advance mechanism is operating, the input feeder will not operate. The stack advance mechanism will remain stopped so long as both sensor 251 and the tilt sensor are triggered. Once either of these sensors is no longer triggered, because, for example, one or more mailpieces in mixed-mail stack 11 has been transported downstream by input feeder 17, thus-reducing the size of mixed-mail stack 11 or tilt of input feeder 17, microprocessor controller 200 transmits a control signal to stack advance mechanism 5 to resume operation. In a preferred embodiment, when stack advance mechanism 5 is accelerated by control signals from microprocessor controller 200, the acceleration is 1.0 g. Conversely, when stack advance mechanism 5 is decelerated, the deceleration is 0.115 g. Preferably, this acceleration and deceleration result in the stack advance mechanism moving at a velocity of 3.56 inches per second ("ips") (~9.04 cm per second ("cps")).

Figure 4:
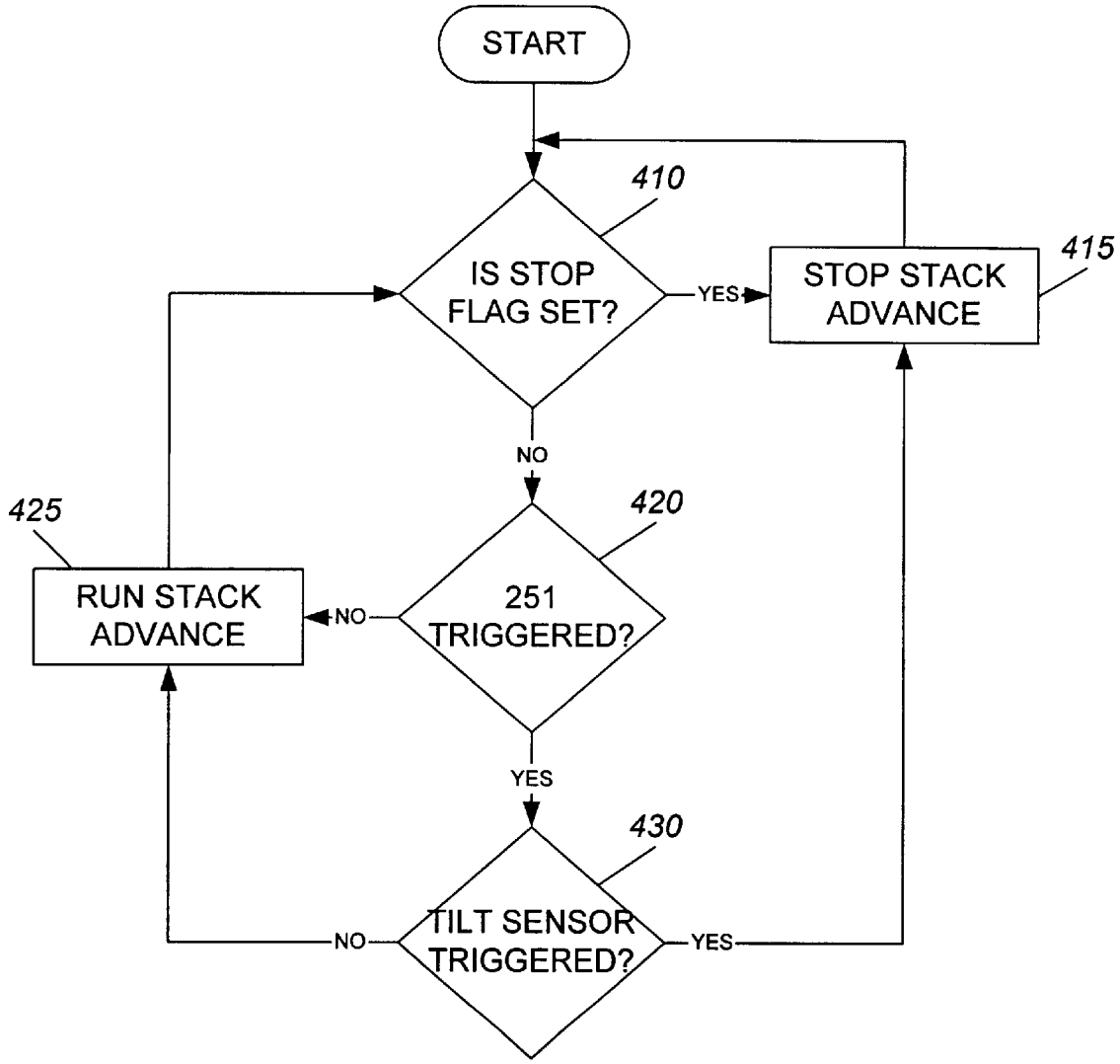
FIG. 4 is a flowchart of a stack advance mechanism control scheme in accordance with an embodiment of the present invention.

This protocol is illustrated in the flowchart in FIG. 4. Step 410 asks whether the "stop flag" is set. The stop flag and conditions for its setting will be discussed below. For the time being, assume that the stop flag is not set. Step 420 then asks whether sensor 251 is triggered by input feeder 17. If not, step 425 runs (or keeps running) stack advance mechanism 5. This loop of steps 420, 425, and 410 continues until sensor 251 is triggered by the position of input feeder 17. At that time, step 430 asks whether the tilt sensor in input feeder 17 is triggered. If not, step 425 runs (or continues to run) stack advance mechanism 5. The flowchart then loops back to determine if sensor 251 is still triggered by input feeder 17. Going back to step 430, if the tilt sensor in input feeder 17 is triggered, there is too much force on input feeder 17 and step 415 stops stack advance mechanism 5 and then loops back to steps 410 and 420.

Figure 2:
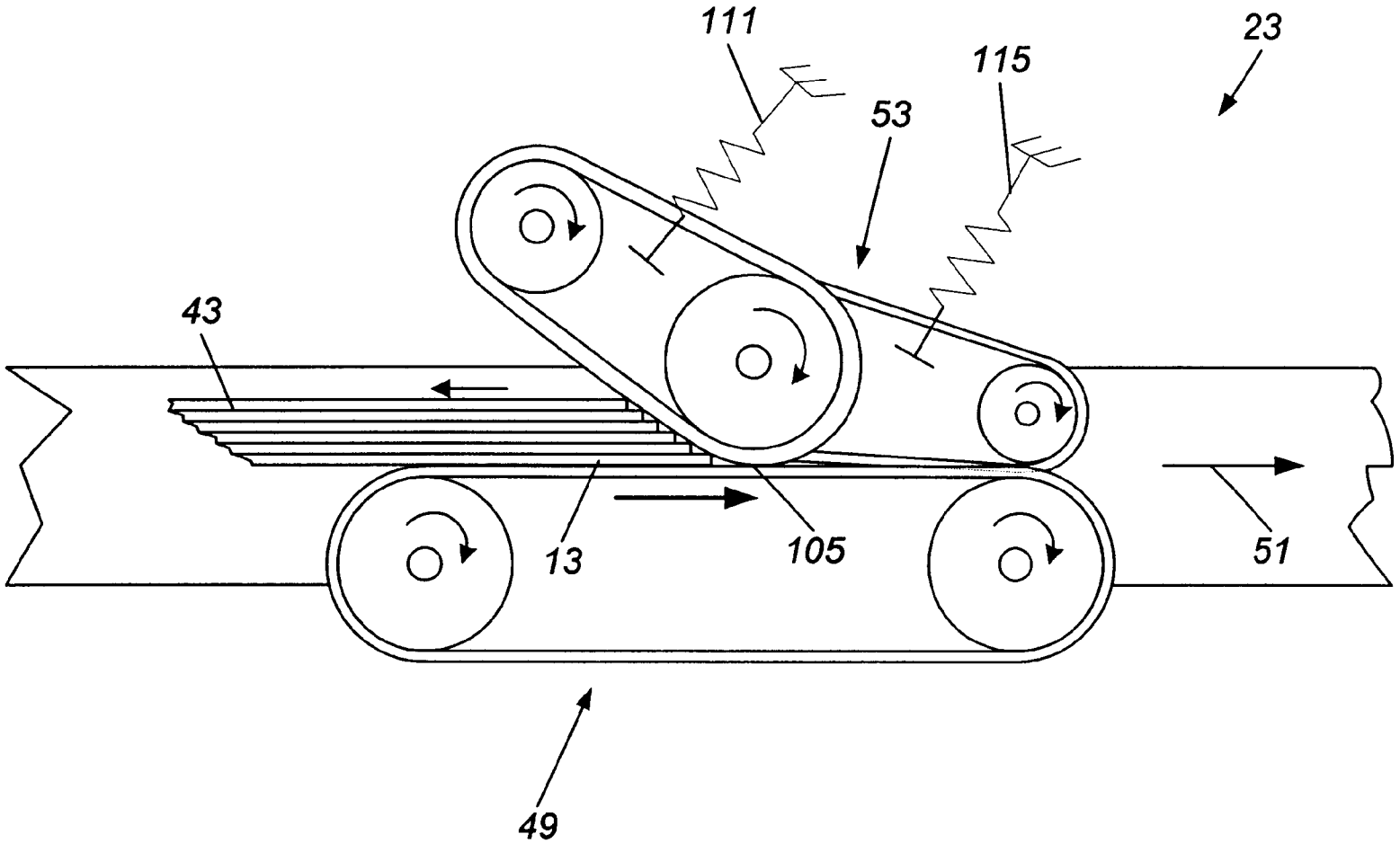
FIG. 2 is an enlarged and detailed top plan view of a singulator of FIG. 1.

From input feeder 17, a mailpiece is transported to first singulator 23. Sensors 201, 203 detect the presence or absence of a mailpiece in first singulator 23 so as to control input feeder 17. Input feeder 17 transports mailpieces 13, 15 from mixed-mail stack 11 laterally to first singulator 23 via belt 18, possibly resulting in a stack 43 of shingled mailpieces in first singulator 23, as is shown in FIG. 2. Sensor 201 is aligned with the beginning of the nip area 105 in first singulator 23 and sensor 203 is aligned with the end of nip area 105 in first singulator 23. Preferably, this results in sensor 201 being placed 48 mm upstream the end of nip area 105; and sensor 203 being placed 9 mm downstream the end of nip area 105.

When light transmitted from transmitter 204 is blocked from being detected by sensor 203 because of a mailpiece blocking the transmission path, sensor 203 generates and transmits to microprocessor 200 a signal that first singulator 23 is full. In response, microprocessor 200 transmits a control signal to input feeder 17 to stop advancing mailpieces into first singulator 23. Although one way to achieve this result (i.e., preventing mailpieces from entering first singulator 23) is by stopping belt 18, it is preferable to leave belt 18 running at a constant speed and to stop driven nudger rollers in input feeder 17 (not shown in FIGS. 1 or 3), which may be mounted on a wall parallel to upstanding panel 9, from operating. Nudger rollers are further described in U.S. Pat. No. 5,971,391, assigned to the assignee of this invention, the disclosure of which is hereby incorporated by reference.

Sensors 201 and 203 together detect when first singulator 23 is clear of mailpieces (sensor 203 detects a trailing edge of a mailpiece). When these two sensors are thus clear, first singulator 23 is deemed to be completely empty. Sensors 201 and 203 generate and transmit signals to microprocessor 200, which, when downstream document-handling subassemblies are in operation (exceptions to which will be discussed shortly), then transmits a control signal to input feeder 17 to resume advancing mailpieces into first singulator 23. In addition, in order to preserve throughput, first singulator 23 is triggered by operation of input feeder 17. (Although this discussion describes the triggering of first singulator 23, it is more precise to describe in a preferred embodiment that first singulator feed assembly 49 is triggered by operation of input feeder 17, because first singulator retard assembly 53 is preferably continuously running at a constant backward velocity, preferably at 4 ips (~10.2 cps).) Alternatively, even if input feeder 17 has not been restarted because either sensor 201 or 203 is blocked, first singulator feed assembly 49 can be restarted to transport a mailpiece toward first output feeder 25 if a downstream mailpiece has completely cleared first output feeder 25 and sensor 213.

Using this scheme, mailpieces are efficiently fed. In a preferred embodiment, when the driven nudger rollers of input feeder 17 are accelerated by control signals from microprocessor controller 200, the acceleration is 0.5 g. Conversely, when the driven nudger rollers of input feeder 17 are decelerated, they decelerate to a stop. Preferably, this acceleration results in the driven nudger rollers operating at a velocity of 37.4 ips (~95 cps). When triggered, first singulator feed assembly 49 also accelerates at 0.5 g, but operates at a final velocity of 42 ips (~107 cps). Even though the accelerations of the two document-handling subassemblies when approaching the final velocities are the same, the velocity of the first singulator feed assembly is generally greater than that of the input feeder so that there is a tension between the first singulator feed assembly and the input feeder to pull the document downstream.

Figure 5:
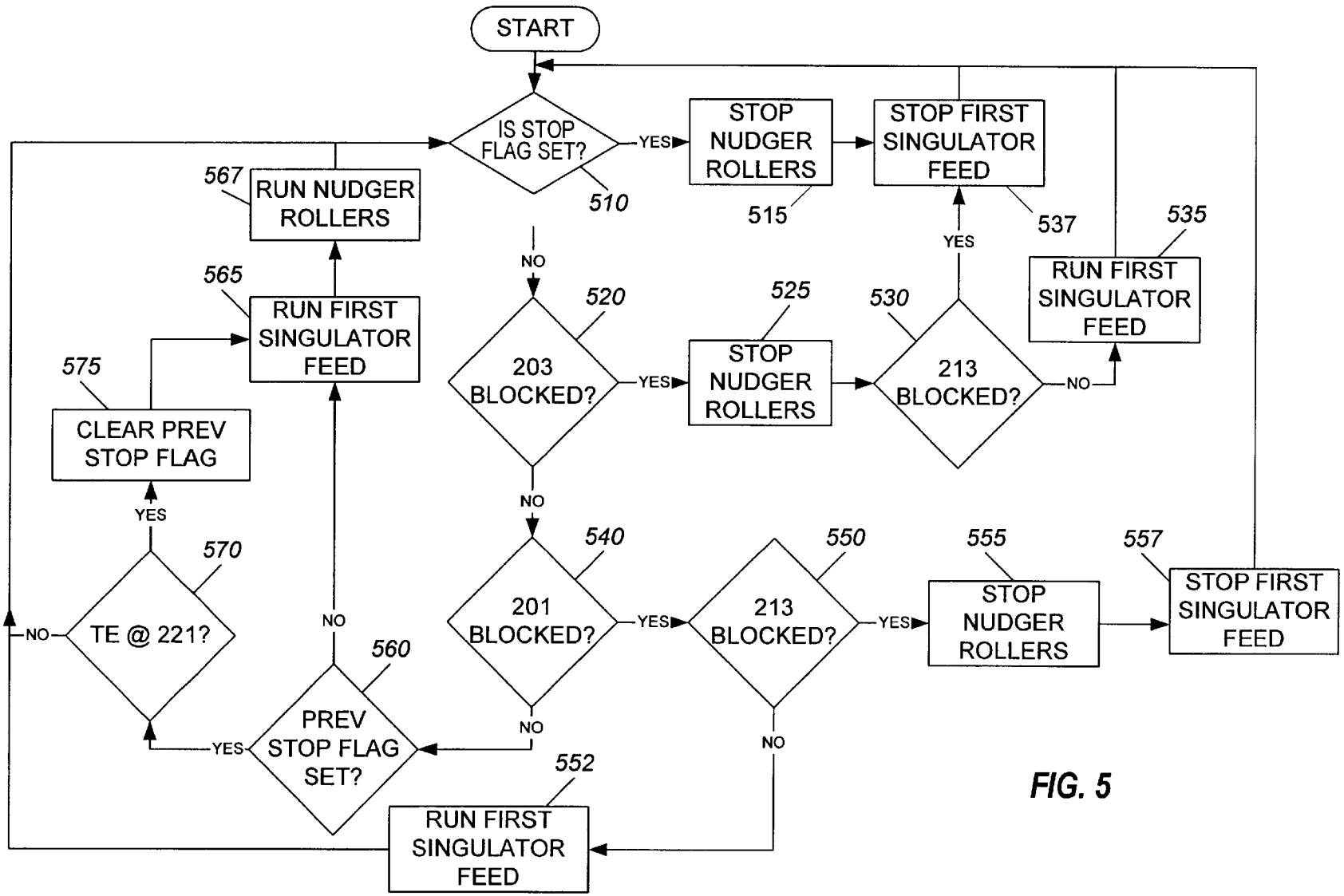
FIG. 5 is a flowchart of an input feeder and first singulator control scheme in accordance with an embodiment of the present invention.

This protocol is illustrated in the flowchart in FIG. 5. Again, as with the discussion of FIG. 4, the first step, step 510, asks whether the stop flag is set. The setting of the stop flag will be discussed below. For the present discussion, assume that the stop flag is not set and has not previously been set. Step 520 asks whether sensor 203 is blocked by a mailpiece in first singulator 23. If so, step 525 stops the driven nudger rollers of input feeder 17. However, as shown by steps 530, 535, and 537, first singulator feed assembly 49 is only stopped if sensor 213 is also blocked. If the answer to step 520 is that sensor 203 is not blocked, step 540 asks whether sensor 201 is blocked.

If sensor 201 is not blocked, first singulator feed assembly 49 runs in step, 565 and driven nudger rollers run in step 567 (assuming the previous stop flag is not set, see step 560), so long as downstream document-handling subassemblies are operating (i.e., the stop flag is not set, discussed below). If the answer to step 540 is that sensor 201 is blocked, step 550 asks whether sensor 213 is blocked. If not, first singulator feed assembly 49 runs (step 552) and the driven nudger rollers continue to run, if they are running, or do not start, if they are stopped. If sensor 213 is blocked, both the driven nudger rollers and first singulator feed assembly 49 stop (steps 555, 557).

From first singulator 23, a mailpiece is transported to first output feeder 25. Sensors. 211, 213 detect the presence or absence of, a mailpiece in that output feeder. These sensors operate in conjunction with sensors 221–227 in aligner 31 and sensor 231 near the entrance to second singulator 39 so as to primarily control first output feeder 25, trap subsystem 100, and feed assembly 50 of second singulator 39, and also to control stack advance mechanism 5, input feeder 17, and first singulator feed assembly 49. A key aspect of this control scheme is the setting of the stop flag (alternatively termed issuance of "stop commands"). The stop flag is set in the event the gap between mailpieces in aligner 31 becomes unacceptably small, as may happen if a multi-feed has advanced to second singulator 39. Preferably, the stop flag is set when there is not at least a two-sensor clearance between mailpieces. In other words, if fewer than two adjacent sensors 221, 223, 225, 227, 231 are blocked by consecutive mailpieces, then the stop flag is set.

Preferably, sensors 211, 213 are placed 20 mm on either side of the nip of first output feeder 25. Sensors 221, 223, 225, 227, and 231 are preferably evenly spaced through the aligner at 65 mm intervals.

The setting of the stop flag increases the gap between the mailpieces by preventing upstream mailpieces from moving downstream. This is preferably accomplished by stopping rollers 27, 29 of first output feeder 25 at the correct moment and may be supplemented by actuating trap subsystem 100 within aligner 31. Once the stop flag is cleared, a protocol is required to restart the various document-handling subassemblies to keep from losing control over the gap.

Figure 6:
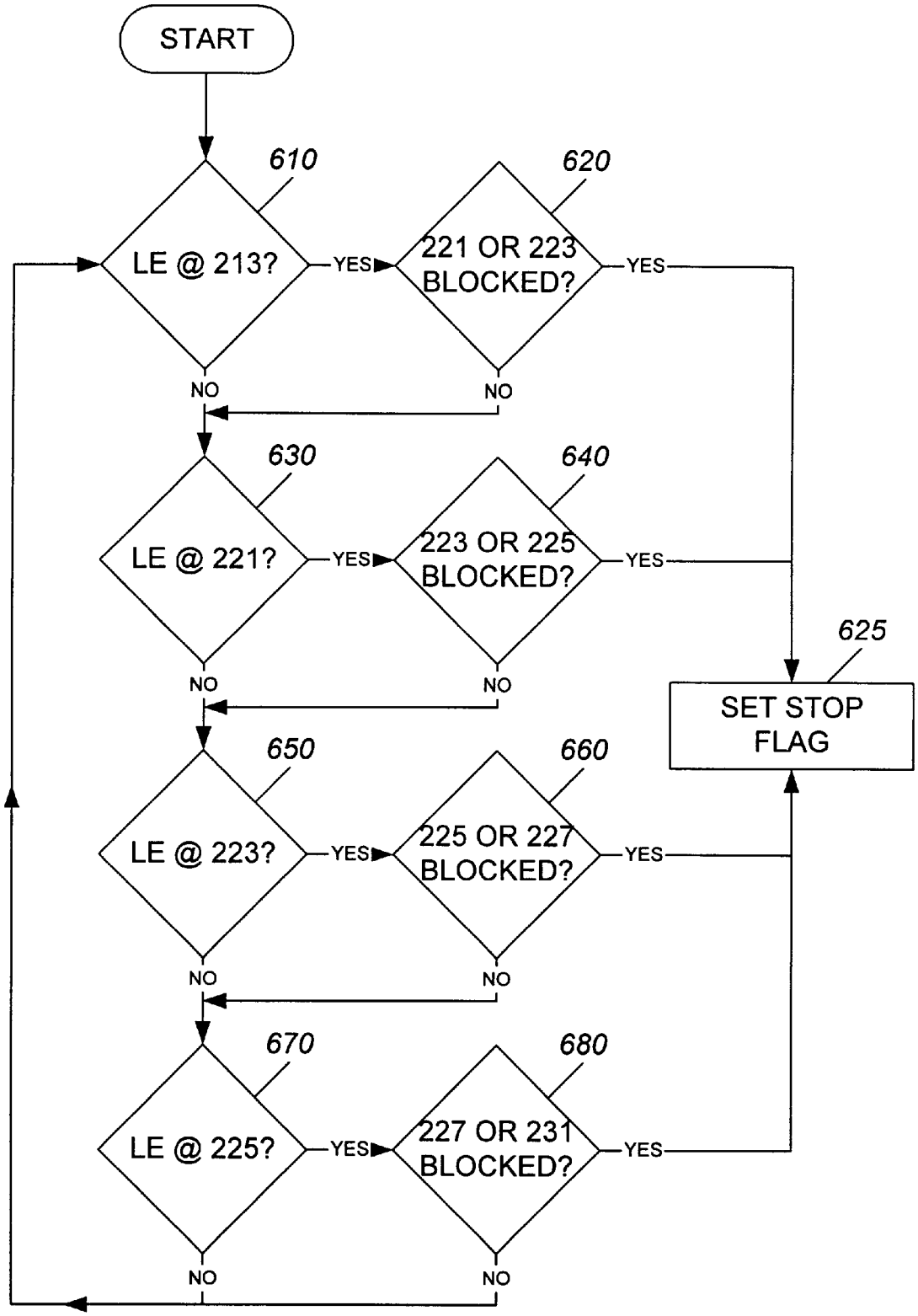
FIG. 6 is a flowchart describing the setting of the stop flag in accordance with an embodiment of the present invention.

FIG. 6 illustrates the "two-sensor look-ahead" protocol for setting the stop flag. In step 610, sensor 213 looks for the leading edge ("LE") of a mailpiece. If the LE is detected, step 620 then looks ahead to the next two sensors, 221 and 223, and asks if either of those is blocked. If so, there is less than a two-sensor gap between the mailpiece whose leading edge is at sensor 213 and a downstream mailpiece. In that case, step 625 sets the stop flag.

If, in step 610, no leading edge is detected at sensor 213 or, in step 620, neither 221 nor 223 is blocked, the protocol proceeds to step 630 to look for a leading edge at sensor 221. If the leading edge is detected at sensor 221, step 640 then looks ahead to the next two sensors, 223 and 225, and asks if either of those is blocked. If so, there is less than a two-sensor gap between the mailpiece whose leading edge is at sensor 221 and a mailpiece further downstrearm. Again, in that case, step 625 sets the stop flag. If, in step 630, no leading edge is detected at sensor 221 or, in step 640, neither 223 nor 225 is blocked, the protocol proceeds to step 650 to look for a leading edge at sensor 223. If the leading edge is detected at sensor 223, step 660 then looks ahead to the next two sensors, 225 and 227, and asks if either of those is blocked. If so, there is less than a two-sensor gap between the mailpiece whose leading edge is at sensor 223 and a mailpiece further downstream. Step 625 sets the stop flag if that is the case.

If, in step 650, no leading edge is detected at sensor 223 or, in step 660, neither 225 nor 227 is blocked, the protocol proceeds to step 670 to look for a leading edge at sensor 225. If the leading edge is detected at sensor 225, step 680 then looks ahead to the next two sensors, 227 and 231 (which is adjacent second singulator 39), and asks if either of those is blocked. If so, there is less than a two-sensor gap between the mailpiece whose leading edge is at sensor 225 and a mailpiece further downstream. In such a case, step 625 sets the stop flag. If, in step 670, no leading edge is detected at sensor 225 or, in step 680, neither 227 nor 231 is blocked, the protocol loops-back to step 610 to look for a leading edge at sensor 213. This protocol illustrated in FIG. 6 is constantly. performed.

Figure 7:
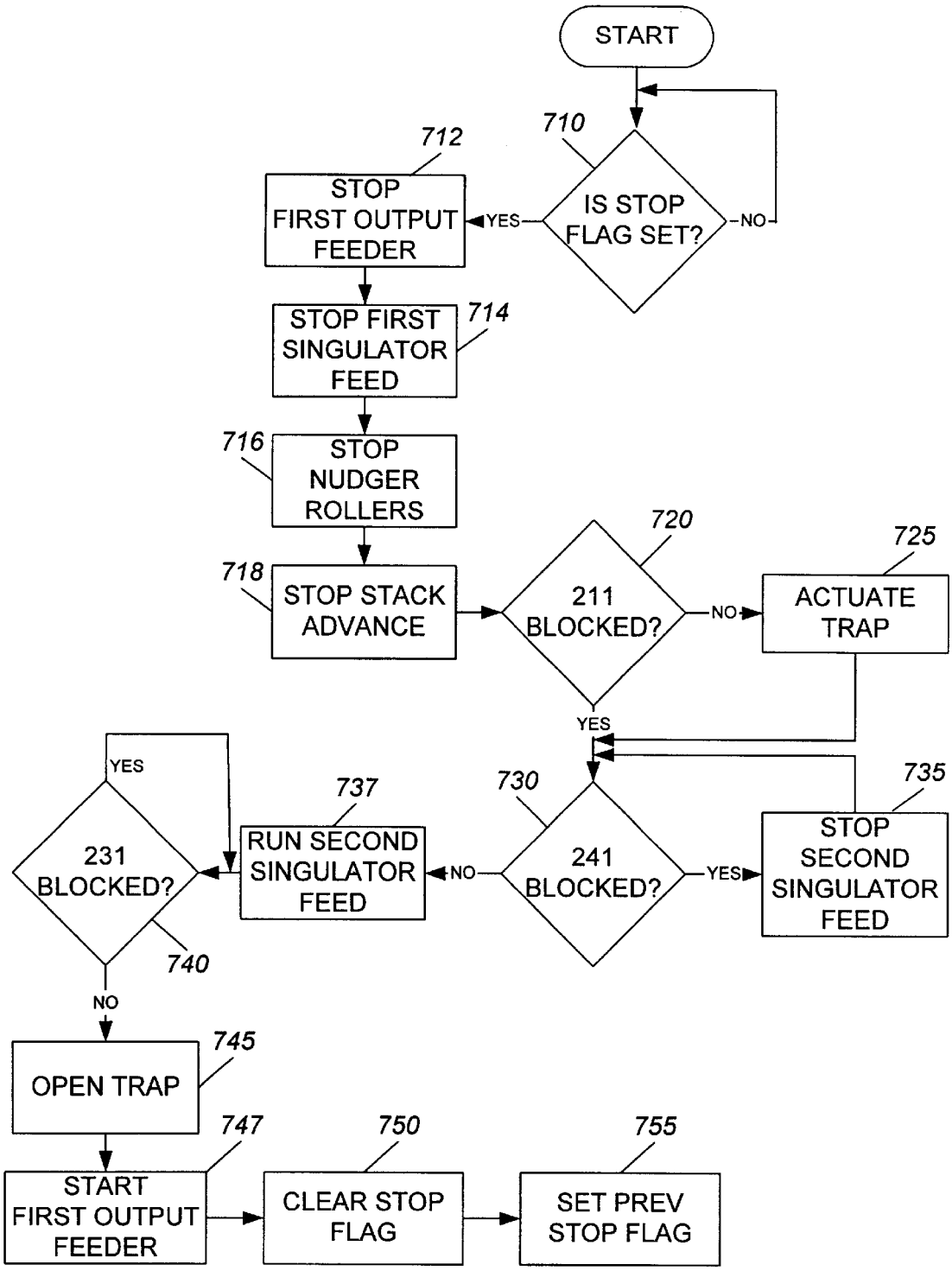
FIG. 7 is a flowchart describing the clearing of the stop flag in accordance with an embodiment of the present invention.

Once the stop flag is set, the protocol illustrated in the flowchart in FIG. 7 takes over in order to determine when to clear the stop flag. Step 710 constantly watches for the setting of the stop flag. When the stop flag is set, step 712 stops first output feeder 25 (i.e., stops take-away rollers 27, 29), step 714 stops first singulator feed assembly 49, step 716 stops the driven nudger rollers in input feeder 17, and step 718 stops stack advance mechanism 5. Note that the combination of steps 710 and 718 is equivalent to steps 410 and 415 in FIG. 4, and the combination of steps 710, 714, and 716 is equivalent to steps 510, 515, and 537 in FIG. 5.

After these four document-handling subassemblies stop in steps 712–718, step 720 looks to see whether sensor 211 is blocked, i.e., whether there is a mailpiece in first output feeder 25. As discussed above, one of the triggers for the stop flag to be set is that there is a leading edge at sensor 213 and less than a two-sensor gap between the document at sensor 213 and the next downstream mailpiece (steps 610 and 620). If this is the condition that caused the stop flag to set, then the mailpiece is still likely to be in first output feeder 25 and sensor 211 will be blocked. In that case, the stopping of first output feeder 25 and take-away rollers 27, 29 will stop the mailpiece from proceeding into aligner 31. For longer mailpieces, it is also possible for the leading edge to be at sensors 221, 223, or 225, and for the tail portion of the mailpiece to still be in first output feeder 25. In these cases also, sensor 211 will be blocked and the stopping of first output feeder 25 and take-away rollers 27, 29 will stop the mailpiece from proceeding into aligner 31.

If the stop flag was set because the leading edge of the mailpiece was at sensors 221, 223, or 225 (steps 630, 650, and 670) and there was less than a two-sensor gap, it is possible, (for smaller mailpieces) for the mailpiece to have cleared first output feeder 25. In that case, the answer to step 720 is "no" (sensor 211 is not blocked), and the stopping of first output feeder 25 cannot stop the mailpiece from proceeding downstream. In that situation, the trap must be actuated, as indicated by step 725.

Once the response to step 720 is resolved, the mail-handling machine looks to clear the stop flag to resume mail flow from the upstream document-handling subassemblies. Because a leading cause of the stop flag being set is a multi-feed that has advanced to second singulator 39, causing documents to back up in aligner 31 and reducing the inter-piece gaps, second singulator 39 has to clear before the upstream mailpieces are allowed to move. However, in order for feed assembly 50 of second singulator 39 to run, second output feeder 41 must be clear. These conditions are set forth beginning with step 730.

Step 730 asks whether sensor 241, which is preferably adjacent the nip of second output feeder 41, is blocked. If so, second output feeder 41 is transporting a mailpiece to processing station 26 and directs step 735 to stop second singulator feed assembly 50 (or cause it to remain stopped). So long as sensor 241 is blocked, second singulator feed assembly 50 will not move. Once the mailpiece clears second output feeder 41 and sensor 241, step 737 starts second singulator feed assembly 50. Step 740 then asks whether sensor 231, which is adjacent the entrance to second singulator 39, is blocked. If so, second singulator 39 still has at least one document in it and the upstream documents should not be sent downstream until the second singulator clears. This condition is indicated by the loop around step 740. Once second singulator 39 is clear, sensor 231 will be unblocked, allowing step 745 to open the trap (if it had been actuated) and step 747 to start the first output feeder. Step 750 then clears the stop flag.

After a stop flag is cleared, first singulator feed assembly 49 is not immediately restarted in order to enforce the gap created by the setting of the stop flag. Thus, if a mailpiece is in first output feeder 25 during the time the stop flag was set, an immediate starting of first singulator feed assembly 49 would result in too small a gap between the document in first output feeder 25 and the next document leaving first singulator 23, thereby possibly causing the stop flag to be set again when the.document leaving first singulator 23 arrives at first output feeder 25. To minimize this possibility, a second flag ("previous stop flag") is set in step 755 after the stop flag is cleared. Returning to FIG. 5, once the stop flag is clear, step 510 returns "no." If both sensors 203 and 201 are unblocked (steps 520 and 540), first singulator 23 is clear. Step 560 then asks whether the previous stop flag is set. As mentioned before with respect to FIG. 5, if the previous stop flag is not set, first singulator feed assembly 49 is set to run in step 565 and the nudger rollers of input feeder 17 can start to run in step 567. If the previous stop flag is set, the first singulator feed assembly cannot run until a trailing edge passes sensor 221 adjacent the beginning of aligner 31. Step 570 accomplishes this task. If the trailing edge of the mailpiece previously stopped in first output feeder 25 or in trap 100 has not yet passed sensor 221, the flowchart in FIG. 5 loops back to the beginning (step 510) to confirm that first singulator 23 is still clear before testing again whether sensor 221 is clear. Once the trailing edge passes sensor 221, step 575 clears the previous stop flag and starts the first singulator feed assembly and driven nudger rollers in steps 565 and 567.

FIGS. 8 and 9 illustrate the general operation of an embodiment of the present invention. Shown are three mailpieces, lead mailpiece 13, second mailpiece 15, and third mailpiece 16, each of which has a leading edge ("LE") and a trailing edge ("TE"). FIG. 8 illustrates normal operation when there are no multi-feeds through first singulator 23. FIG. 8*a* is a snapshot of the mailpiece-handling protocol at a first increment in time. Each of the mailpieces 13, 15, 16 also includes an arrow 13*a*, 15*a*, 16*a*, respectively, denoting that the mailpiece is currently moving in the direction of the arrow. Mailpieces 13, 15, 16 are shown in stack advance mechanism 5 and input feeder 17, with driven nudger rollers in input feeder 17 preferably accelerating at 0.5 g to 37.4 ips and first singulator feed assembly 49 preferably accelerating at 0.5 g to 42 ips.

Figure 8A:
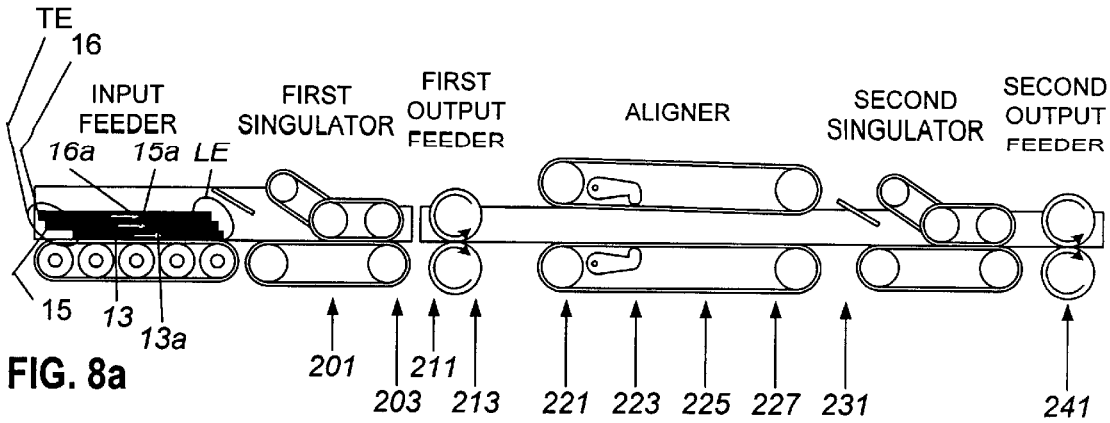
FIGS. 8*a*–8*j* are schematic top plan views of the mixed-mail feeder of the present invention showing the various stages of document handling when no stop flag is set, according to an embodiment of the present invention.
Figure 8B:
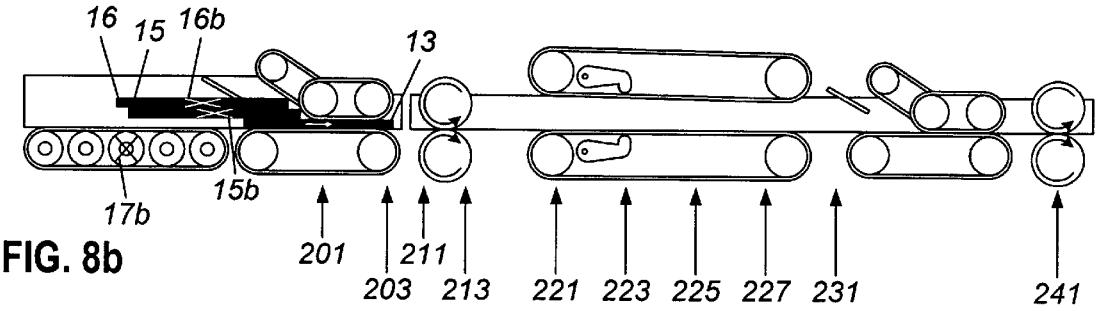

FIG. 8*b* shows the next increment of time in which all three mailpieces have advanced to first singulator 23, and mailpiece 13 has been driven into nip 105, leaving mailpieces 15 and 16 shingled behind. When the leading edge of mailpiece 13 ("LE13") is sensed by sensor 203, the driven nudger rollers of input feeder 17 are decelerated to a stop, to prevent mail from being overstuffed into the first singulator (FIG. 5, steps 520 & 525). Mailpieces 15, 16 are stopped by first singulator retard assembly 53, and each of mailpieces 15, 16 also includes an X 15*b*, 16*b*, respectively, denoting that the mailpiece is currently stopped. Input feeder 17 also includes an X 17*b* to indicate that the nudger rollers have stopped.

Figure 8C:
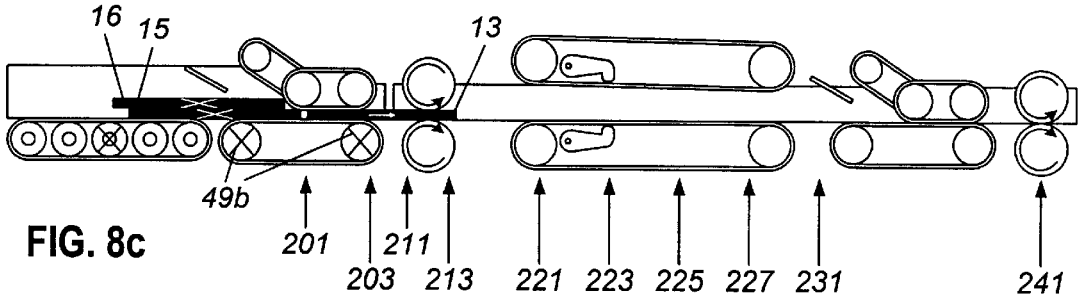

When LE13 is sensed by sensor 213 (at the exit of first output feeder 25) in FIG. 8*c*, first singulator feed assembly 49 stops to allow first output feeder 25 to strip mailpiece 13 from first singulator 23 (steps 530 & 537). X's 49*b* indicate that first singulator feed assembly 49 has stopped.

Figure 8D:
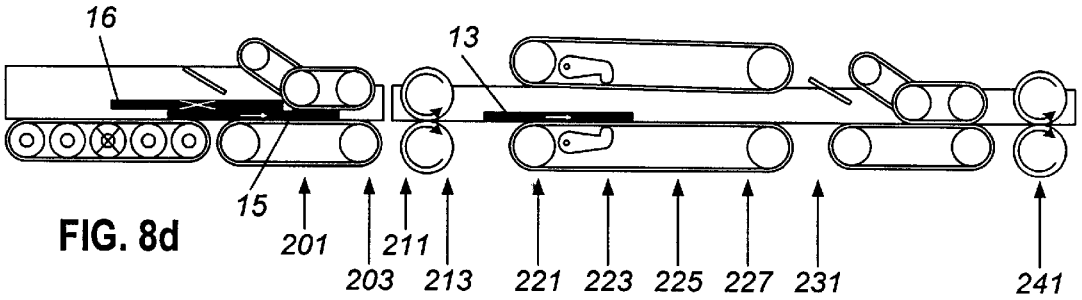

When the trailing edge of mailpiece 13 ("TE13") passes sensor 203, and sensors 201 and 203 are clear, the driven nudger rollers and first singulator feed assembly 49 will accelerate up to speed (steps 565 & 567) in order to retain adequate throughput by keeping first singulator 23 full. When the leading edge of mailpiece 15 ("LE15") passes sensor 201, if sensor 213 is blocked (by mailpiece 13), the driven nudger rollers and first singulator feed assembly 49 stop (steps 555 & 557). Once TE13 passes sensor 213, first singulator feed assembly 49 runs (step 552) and the driven nudger rollers remain stopped, as shown in FIG. 8*d*. Once mailpiece 13 is in aligner 31, mailpiece 13 is driven by under-riding transport belt 42. Preferably, transport belt 42 runs continuously at a constant velocity of 42 ips (~107 cps).

Figure 8E:
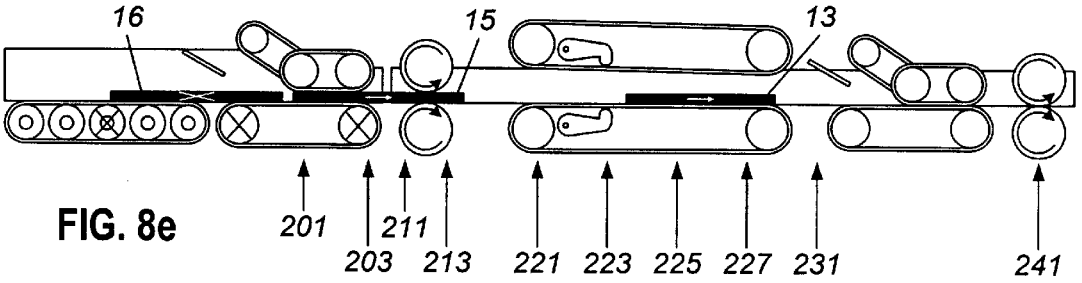

When LE15 reaches sensor 203, the driven nudger rollers remain stopped (step 525), but, because sensor 213 is not blocked, first singulator feed assembly 49 will keep going (step 535). Then, as shown in FIG. 8*e*, once LE15 reaches sensor 213, because sensor 203 is blocked, first singulator feed 5 assembly 49 stops (step 537) and first output feeder 25 strips mailpiece 15 from first singulator 23. LE15 passing sensor 213 also starts the two-sensor look-ahead protocol, but because both sensors 221 and 223 are clear, no stop condition is met (steps 610 & 620).

Figure 8F:
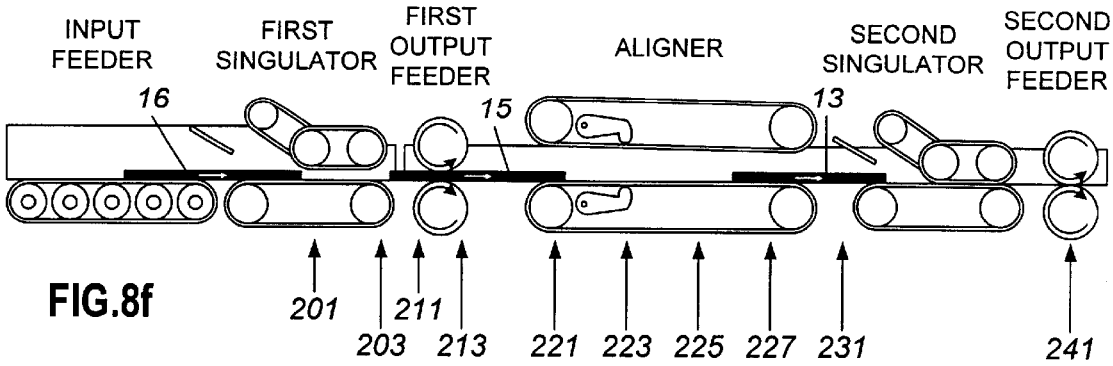

FIG. 8*f* shows the trailing edge of mailpiece 15 ("TE15") passing sensor 203. When sensors 201 and 203 are clear, the driven nudger rollers and first singulator feed assembly 49 are accelerated up to speed (steps 565 & 567). FIG. 8*f* also shows that the stop condition is again not met when LE15 passes sensor,221, because sensors 223 and 225 are clear (steps 630 & 640). The aligner indirectly drives mailpiece 13 into second singulator 39 (FIG. 8*g*), the feed assembly of which was accelerated (preferably at 2.0 g) up to velocity (preferably 35.4 ips (~90 cps)) when mixed-mail feeder 1 was turned on.

Figure 8G:
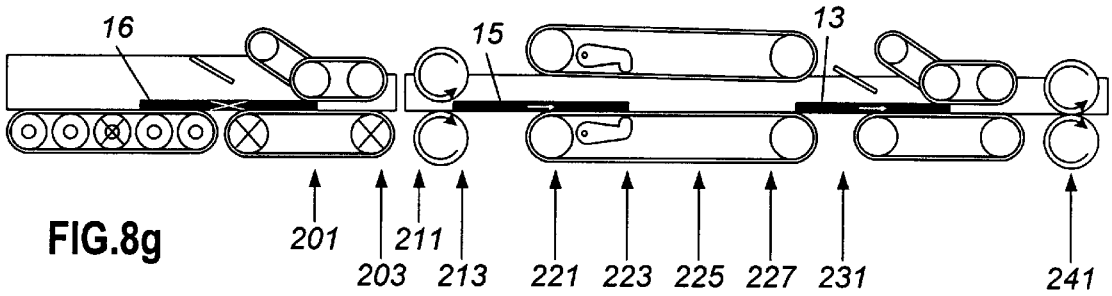

When the leading edge of mailpiece 16 ("LE16") passes sensor 201, if sensor 213 is blocked (by mailpiece 15), the driven nudger rollers and first singulator feed assembly 49 stop (steps 555 & 557), as shown in FIG. 8*g*. FIG. 8*g* also shows that the stop condition is again not met when LE15 passes sensor 223, because sensors 225 and 227 are clear (steps 650 & 660).

Figure 8H:
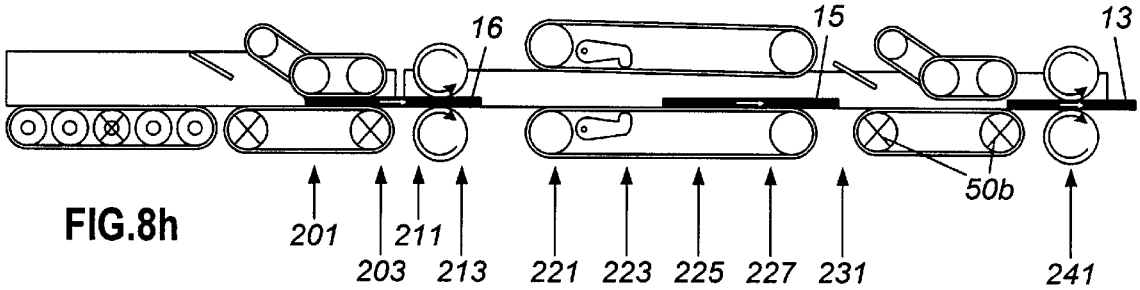

Once TE15 passes sensor 213, first singulator feed assembly 49 runs (step 552) because sensor 203 is clear, but the driven nudger rollers remain stopped. When LE16 reaches sensor 203, the driven nudger rollers remain stopped (step 525), and, because sensor 213 is not blocked, first singulator feed assembly 49 will keep running (step 535). Then, as shown in FIG. 8*h*, once LE16 reaches sensor 213, because sensor 203 is blocked, first singulator feed assembly 49 stops (step 537) and first output feeder 25 strips mailpiece 16 from first singulator 23. FIG. 8*h* also shows sensor 241 blocked by mailpiece 13, which causes second singulator feed assembly 50 to stop, as indicated by X 50*b*. Second output feeder 41 strips mailpiece 13 from second singulator 39. Preferably, second output feeder 41 runs constantly at 35.4 ips (~90 cps).

Figure 8I:
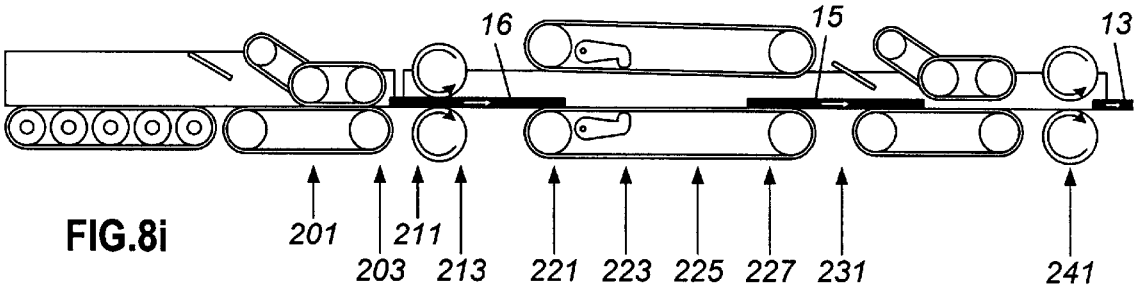

FIG. 8*i* shows the trailing edge of mailpiece 16 ("TE16") passing sensor 203. When sensors 201 and 203 are clear, the driven nudger rollers and first singulator feed assembly 49 are accelerated up to speed (steps 565 & 567). FIG. 8*i* also shows TE13 passing sensor 241 toward processing station 26. This re-accelerates second singulator feed assembly 50 at 2.0 g, preferably, so that second singulator feed assembly 50 is running at 35.4 ips by the time mailpiece 15 reaches second singulator 39.

Figure 8J:
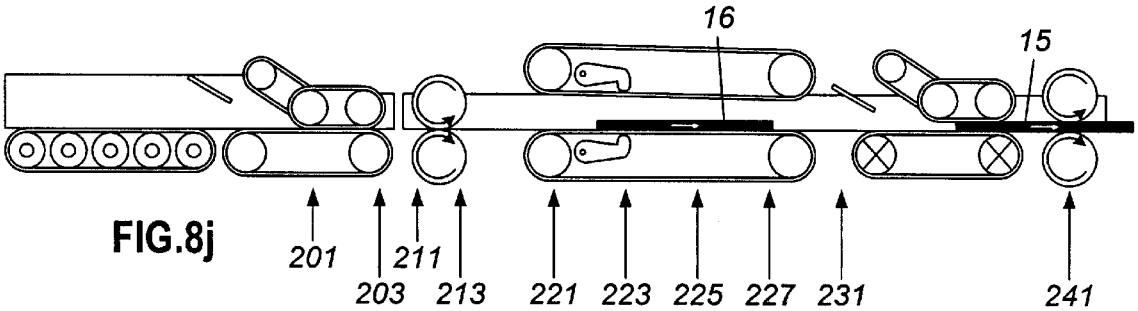
Figure 9A:
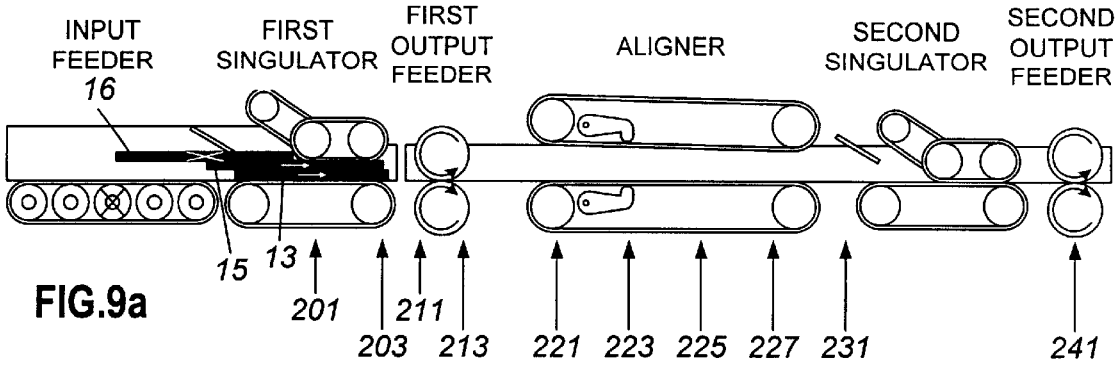
FIGS. 9*a*–9*j* are schematic top plan views of the mixed-mail feeder of the present invention showing the various stages of document handling when the stop flag is set, according to an embodiment of the present invention.

When LE15 passes sensor 241, second singulator feed assembly 50 stops, as shown in-FIGURE 8*j*. Mailpiece 16 continues to be transported through aligner 31 toward second singulator 39. When TE15 passes sensor 241 toward processing station 26, second singulator feed assembly 50 will accelerate, driving mailpiece 16 through to second output feeder 41 and on to processing station 26. FIG. 9 illustrates operation when a stop condition is activated. Such a condition might occur if mailpieces 13 and 15 enter aligner 31 together (i.e., a multi-feed). FIG. 9*a* shows mailpieces 13 and 15 multi-feeding in first singulator 23, where the driven nudger rollers have just stopped when LE13 passed sensor 203 (step 525).

Figure 9B:
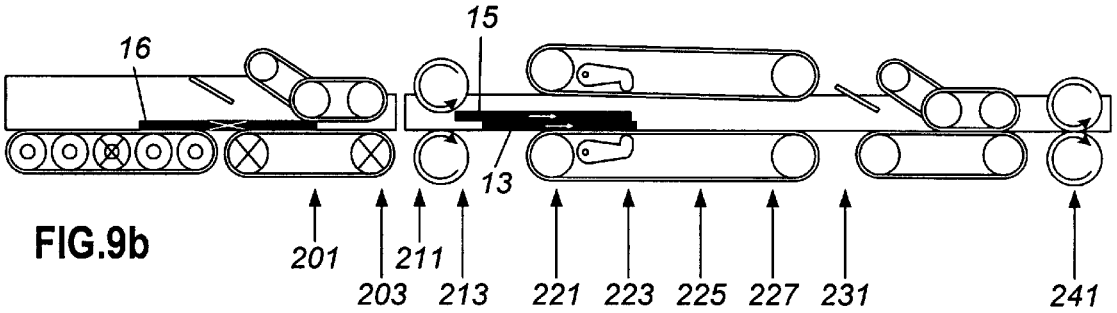

When LE13 is sensed by sensor 213, first singulator feed assembly 49 stops (steps 530 & 537). When TE15 passes sensor 203, and sensors 201 and 203 are clear, the driven nudger rollers and first singulator feed assembly 49 will accelerate up to speed (steps 565 & 567). When LE16 passes sensor 201, if sensor 213 is blocked (by mailpieces 13 and 15), the driven nudger rollers and first singulator feed assembly 49 stop (steps 555 & 557), as shown in FIG. 9*b*.

Figure 9C:
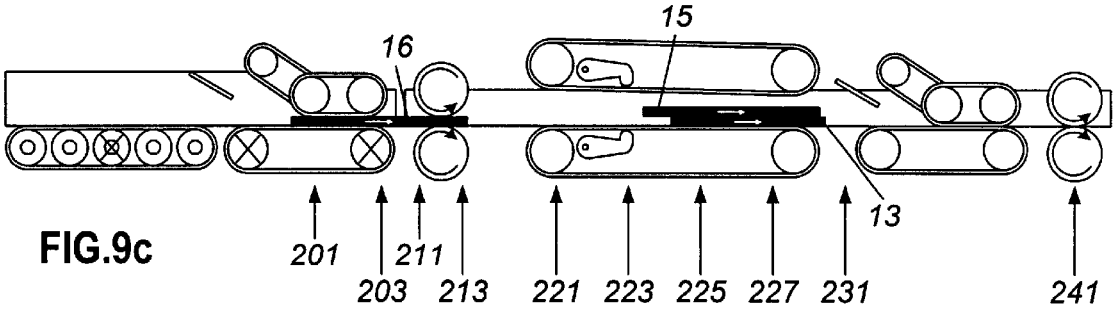
Figure 9D:
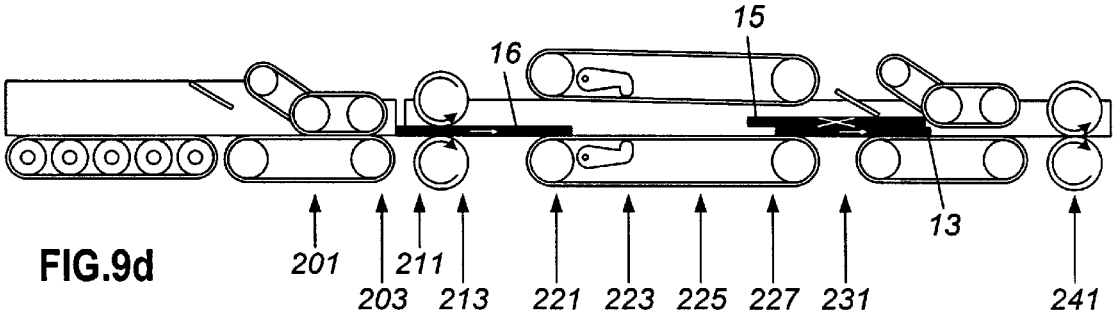

Once TE15 passes sensor 213, first singulator feed assembly 49 runs (step 552), but the driven nudger rollers remain stopped. Once mailpieces 13 and 15 are in aligner 31, mailpieces 13 and 15 are driven by under-riding transport belt 42. When LE16 reaches sensor 203, the driven nudger rollers remain stopped (step 525), and, because sensor 213 is not blocked, first singulator feed assembly 49 will keep running (step 535). Then, as shown in FIG. 9*c*, once LE16 reaches sensor 213, because sensor 203 is blocked, first singulator feed assembly 49 stops (step 537) and first output feeder 25 strips mailpiece 16 from first singulator 23. LE16 passing sensor 213 also starts the two-sensor look-ahead protocol, but because both sensors 221 and 223 are clear, no stop condition is met (steps 610 & 620). FIG. 9*d* shows TE16 passing sensor 203. When sensors 201 and 203 are clear, the driven nudger rollers and first singulator feed assembly 49 are accelerated (steps 565 & 567). FIG. 9*d* also shows that the stop condition is again not met when LE16 passes sensor 221, because sensors 223 and 225 are clear (steps 630 & 640). Multi-feed 13/15 is shown entering second singulator 39.

Figure 9E:
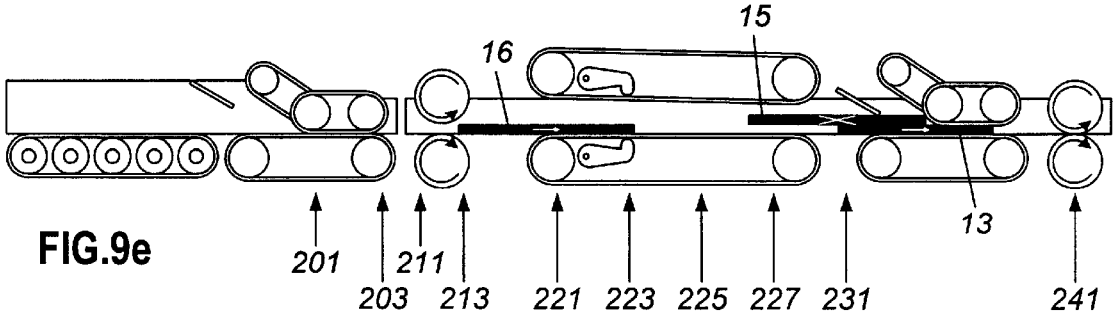

FIG. 9*e* shows TE16 just before it passes sensor 213. Driven nudger rollers and first singulator feed assembly 49 are still running because sensors 201 and 203 are clear. Second singulator 39 is separating mailpiece 13 from mailpiece 15, as mailpiece 16 is being transported into aligner 31. The two-sensor look-ahead sees LE16 at sensor 223 and checks to see if sensors 225 and 227 are clear (steps 650 & 660). Because sensor 227 is not clear, the stop flag is set (step 625).

Figure 9F:
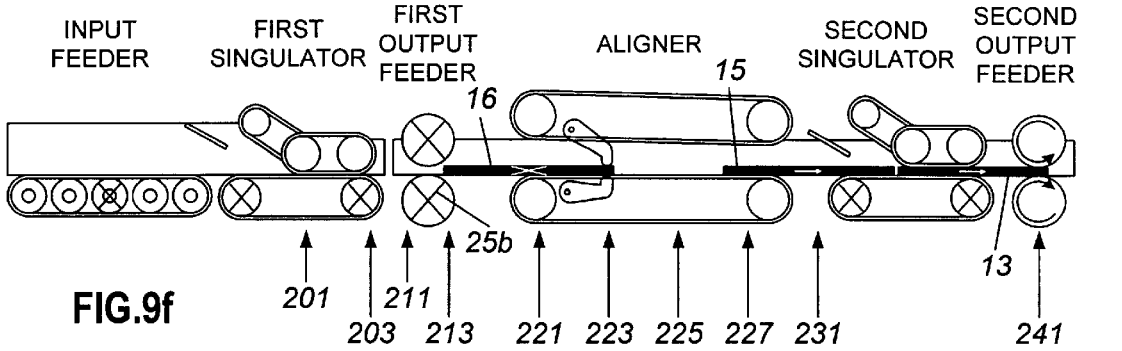

Once the stop flag is set, FIG. 9*f* shows that first output feeder 25 is stopped (step 712), indicated by X 25*b*, first singulator feed assembly 49 is stopped (step 714), and driven nudger rollers are stopped (step 716). It is preferable that first output feeder 25 is decelerated at 1.0 g. If TE16 were still in first output feeder 25, rollers 27, 29 would catch mailpiece 16 and stop it from advancing into aligner 31. Sensor 211 is checked to see if a mailpiece is still in first output feeder 25 (step 720). In FIG. 9*f*, the answer is no, so trap 100 must be actuated (step 725). Trap 100 is positioned in aligner 31 such that it will stop the shortest mailpiece at the last stopping position and, at the same time, will not pinch the longest mailpiece which is waiting at second singulator 39. When the flag was set, second singulator feed assembly 50 remained running in order to clear the multi-feed. Once LE13 passed sensor 241, second singulator feed assembly 50 stops (step 735), and second output feeder 41 strips mailpiece 13 from second singulator 39.

Figure 9G:
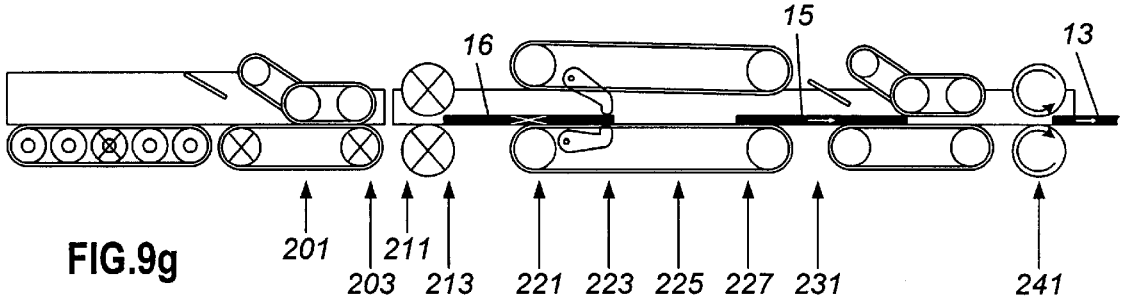

In FIG. 9*g*, the stop flag is still set, and mailpiece 13 is clear of sensor 241, thus re-accelerating second singulator feed assembly 50 (step 737) and mailpiece 15. Because mailpiece 15 blocks sensor 231, all upstream document handling subassemblies remain stopped (step 740).

Figure 9H:
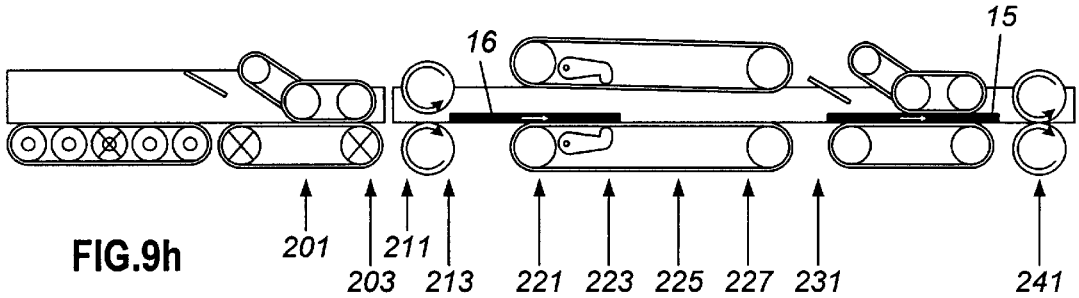

Once TE15 clears sensor 231, the trap can open (step 745) and first output feeder 25 can start up again (step 747), as shown in FIG. 9*h*. First output feeder 25 is preferably accelerated at 1.0 g to achieve a desired velocity of 42 ips (~107 cps). The stop flag is then cleared (step 750) and the previous stop flag is set (step 755). Although sensors 201 and 203 are clear (steps 520 & 540), because the previous stop flag is set (step 560), first singulator feed assembly 49 and the driven nudger rollers are not restarted until mailpiece 16 clears sensor 221 (step 570).

Figure 9I:
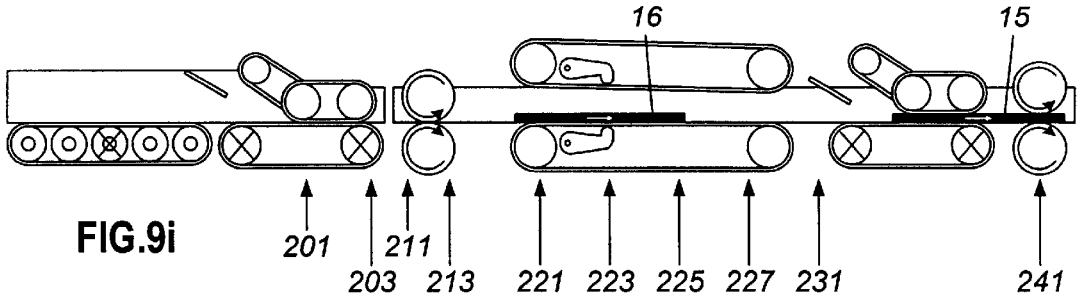
Figure 9J:
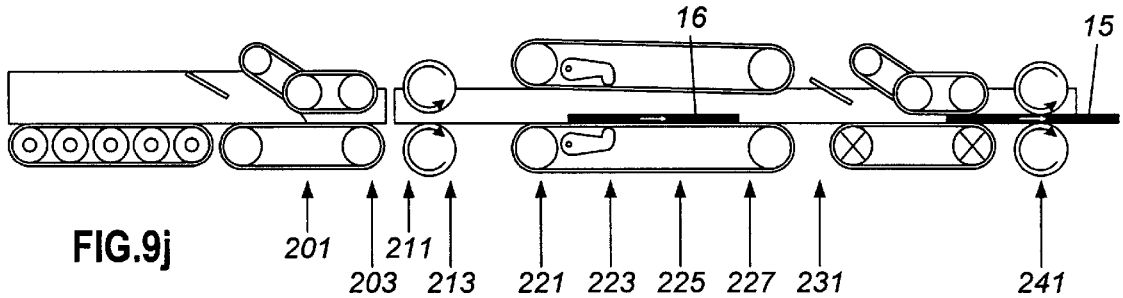

FIG. 9*i* shows mailpieces 15 and 16 advancing. Because mailpiece 15 blocks sensor 241, second singulator feed assembly 50 stops. Because mailpiece 16 has not yet passed sensor 221, first singulator feed assembly 49 and the driven nudger rollers are still not yet restarted. Once TE16 clears sensor 221, as shown in FIG. 9*j*, the previous stop flag is cleared (step 575) and first singulator feed assembly 49 and the driven nudger rollers are reaccelerated (steps 565 & 567).

The conditions and protocol for preferred operation of the document-handling subassemblies are summarized in TABLE 1.

Additional advantages and modifications will readily occur to those skilled in the art. Therefore, the invention in its broader aspects is not limited to the specific embodiments, details, and representative devices shown and described herein. Accordingly, various changes, substitutions, and alterations may be made to such embodiments without departing from the spirit or scope of the general inventive concept as defined by the appended claims. For example while the preferred embodiment is described in connection with a mail-handling machine, any apparatus for handling mixed or same sizes/thicknesses of documents or other articles can use the principles of the invention. Additionally, while singulators incorporating belts are described, it is known to use rollers in lieu of the belts. Furthermore, the retard assembly of second singulator 39 can also optionally be driven in two directions (backward and forward) to effectively process shearable documents. In addition, the preferable velocities and accelerations, as well as the preferable sensor placements, may be modified based on the dimensions, thicknesses, and weights of the documents being processed.

TABLE 1

| Subassembly | Motion | Accel | Decel | Velocity | Start Trigger(s) | Stop Trigger(s) |
|---|---|---|---|---|---|---|
| Stack Advance | Accel/Vel/Decel | 1.0 g | 0.115 g | 3.56 ips | Either or both sensor 251 or tilt sensor not tripped: stack advance runs | Sensor 251 and tilt sensor tripped: stack advance stops |
| Nudger Rollers | Accel/Vel/Decel | 0.5 g | Stop | 37.4 ips | Trailing edge at sensor 203 and sensor 201 unblocked if no piece previously "trapped"; triggered when trailing edge passes sensor 221 if piece previously "trapped" | Stop flag set; Leading edge at sensor 203; Leading edge at sensor 213 if sensor 201 is blocked |
| Belt 18 | Constant | — | — | TBD | — | — |
| First Singulator Feed | Accel/Vel/Decel | 0.5 g | Stop | 42 ips | Triggered with nudger rollers or trailing edge at sensor 213 if no piece previously "trapped"; if piece | Stop flag set; Leading edge at sensor 213 if sensor 201 or sensor 203 is blocked |

TABLE 1-continued

| Subassembly | Motion | Accel | Decel | Velocity | Start Trigger(s) | Stop Trigger(s) |
|---|---|---|---|---|---|---|
| | | | | | previously "trapped," trailing edge passes sensor 221 | |
| First Singulator Retard | Constant | — | — | 4 ips | — | — |
| First Output Feeder | Accel/Vel/Decel | 1.0 g | 1.0 g | 42 ips | Trailing edge passes sensor 231 if stop flag set; otherwise running at constant velocity | Stop flag set |
| Transport belt | Constant | — | — | 42 ips | — | — |
| Trap | On exception | — | — | — | Stop flag set and trailing edge is passed sensor 211 | Trailing edge passes sensor 231 if stop flag set |
| Second Singulator Feed | Accel/Vel/Decel | 2.0 g | Stop | 35.4 ips | Trailing edge at sensor 241 | Leading edge at sensor 241 |
| Second Singulator Retard | Constant | — | — | 4 ips | — | — |
| Second Output Feeder | Constant | — | — | 35.4 ips | — | — |

We claim:

1. An apparatus for transporting documents along a document feed path from an upstream end to a downstream end, comprising;

a plurality of document-handling subassemblies disposed along the document feed path for feeding the documents along the document feed path, singulating the documents, controlling gaps between the documents, and/or conveying the documents toward the downstream end;

a sensor mounted along the document feed path for sensing the positions of the documents and for generating position signals based on the document positions; and a control apparatus for receiving the position signals and for controlling the velocity and acceleration of the document-handling subassemblies so as to regulate the size of the document gaps and to maximize document throughput.

2. The apparatus according to claim 1, further comprising:

a stack of documents of varying sizes disposed at the upstream end; and a document-handling subassembly comprising a stack advance mechanism disposed at the upstream end for advancing documents from the document stack to the input feeder.

3. The apparatus according to claim 2, further comprising at least one stack advance sensor for controlling the stack advance mechanism.

4. The apparatus according to claim 2, further comprising:

a document-handling subassembly comprising a first output feeder disposed between a first singulator and a conveyor belt for taking the documents from the first singulator; and a document-handling subassembly comprising a second output feeder disposed between a second singulator and the downstream end for taking the documents from the second singulator and for transporting the documents to the downstream end.

5. The apparatus according to claim 4, wherein the sensor is aligned with the beginning of the nip area of the first singulator.

6. The apparatus according to claim 5, further comprising second through eighth sensors mounted along the document feed path for sensing positions of the documents and for generating position signals based on the document positions, wherein:

the second sensor is aligned downstream the nip of the first singulator;

the third sensor is aligned downstream the second sensor and upstream the nip of the first output feeder;

the fourth sensor is aligned downstream the nip of the first output feeder;

the fifth and sixth sensors are aligned downstream the fourth sensor and aligned with an aligning area;

the seventh sensor is aligned downstream the aligning area and upstream the nip of the second singulator; and the eighth sensor is aligned with the nip of the second output feeder.

7. The apparatus according to claim 6, wherein:

the sensor and the second sensor sense when a document is clear of the first singulator, so as to start the input feeder and first singulator operating;

the third sensor senses when a document is in the first output feeder, so as to stop the first output feeder from operating if a stop flag is set;

the fourth sensor senses when a document is clear of the first output feeder, so as to start the first singulator operating unless the stop flag is set, and senses when a document is in the first output feeder, so as to set the stop flag in conjunction with the fifth and sixth sensors;

the fifth and sixth sensors sense an unacceptably small document gap, so as to set the stop flag;

the seventh sensor senses an acceptable document gap, so as to clear the stop flag and to accelerate the first output feeder after the stop flag is cleared; and the eighth sensor senses when a document is clear of the second output feeder, so as to cause the second singulator to send a second document into the second output feeder.

8. The apparatus according to claim 6, wherein the aligning area further comprises a document-handling subassembly comprising a trap for preventing a document from being conveyed along the document feed path when the gap between the document and a downstream document is unacceptably small and the first output feeder is unable to stop the document.

9. An apparatus for transporting documents along a document feed path from an upstream end to a downstream end, comprising:

a stack advance mechanism disposed at the upstream end for advancing the documents from a document stack;

an input feeder downstream the stack advance mechanism for receiving the documents from the stack advance mechanism and for feeding the documents along the document feed path;

a first singulator disposed downstream the input feeder for singulating the documents as they are transported from the input feeder;

a first output feeder disposed downstream the first singulator for taking the documents from the first singulator;

a conveyor belt running between the first output feeder and the downstream end for conveying the documents downstream along the document feed path after the documents leave the first output feeder;

an aligning area disposed downstream the first output feeder, through which the documents are bottom-edge aligned as they are conveyed on the conveyor belt;

a second singulator disposed downstream the aligning area for further singulating the documents as they are transported from the aligning area;

a second output feeder disposed downstream the second singulator for taking the documents from the second singulator and transporting the documents to the downstream end; and at least one sensor disposed along the document feed path for sensing the positions of the documents and for generating position signals to control the velocity and acceleration of the stack advance mechanism, the input feeder, first and second singulators, and first and second output feeders so as to coherently control the size of gaps between the documents and maximize document throughput.

10. The apparatus according to claim 9, wherein the aligning area further comprises a trap for preventing a document from being conveyed along the document feed path when the gap between the document and a downstream document is unacceptably small and the first output feeder is unable to stop the document.

11. A method for transporting documents along a document feed path from an upstream end to a downstream end, comprising the steps of:

singulating the documents;

conveying the documents toward the downstream end;

sensing the positions of the documents;

generating position signals based on the document positions;

using the position signals, coherently controlling the velocity and acceleration of the documents along the document feed path so as to regulate the size of the gaps between the documents and to maximize document throughput; and controlling the velocity and acceleration of a singulator and output feeder disposed downstream the singulator.

12. The method according to claim 11, further comprising the steps of: sensing the size of gaps between the documents.

13. The method according to claim 12, further comprising the step of:

controlling a trap mechanism downstream the output feeder to prevent a document from being conveyed along the document feed path when the gap between the document and a downstream document is unacceptably small and the output feeder is unable to stop the document.

* * * * *